United States Patent [19]

Morse et al.

[11] 4,122,523

[45] Oct. 24, 1978

[54] ROUTE CONFLICT ANALYSIS SYSTEM FOR CONTROL OF RAILROADS

[75] Inventors: Charles W. Morse; John P. Walker; Chan-Yong Chew, all of Rochester, N.Y.

[73] Assignee: General Signal Corporation, Rochester, N.Y.

[21] Appl. No.: 751,498

[22] Filed: Dec. 17, 1976

[51] Int. Cl.[2] ..... G06F 15/48; B61L 27/00

[52] U.S. Cl. ..... 364/436; 246/5; 340/23; 340/49; 364/107; 364/900

[58] Field of Search ..... 235/150.24; 246/3, 5; 340/22, 23, 47, 49; 364/200, 900, 436, 105, 107, 119

[56] References Cited

U.S. PATENT DOCUMENTS

| | | | |
|---|---|---|---|
| 3,211,907 | 10/1965 | Blaisdell et al. | 246/3 |
| 3,740,548 | 6/1973 | Hoyler | 246/3 |
| 3,836,768 | 9/1974 | Clarke et al. | 246/3 |
| 3,974,481 | 8/1976 | Lediev et al. | 364/200 |
| 3,976,272 | 8/1976 | Murray et al. | 235/150.24 |

OTHER PUBLICATIONS

*Railway System Controls;* "CP Has Process Control At Alyth"; Mar., 1972, pp. 11, 13-16.

*Primary Examiner*—Malcolm A. Morrison
*Assistant Examiner*—Errol A. Krass
*Attorney, Agent, or Firm*—Pollock, Vande Sande & Priddy

[57] ABSTRACT

A centralized traffic control system for complex railroad areas analyzes the intended path of travel of various trains to determine the existence of any conflicts. When one or more conflicts are detected, the system analyzes various options to resolve the conflict with a minimum disruption to the system based on predetermined constraints. The analysis proceeds on the basis of a heuristic search for conflict resolution. A successful resolution of the conflict is then implemented without requiring operator intervention.

11 Claims, 33 Drawing Figures

SCHEDULE

| TRN | LOCATION 1 | 2 | 3 | 4 | 5 | 6 | 7 | 8 | 9 | 10 ..... |
|---|---|---|---|---|---|---|---|---|---|---|
| 123 | ~ | | ~ | ~ | | | ~ | ~ | | |
| 124 | ~ | ~ | | | ~ | ~ | | | ~ | |
| 125 | ~ | | ~ | | | | | | | |
| 126 | | | | | | | | | | |
| | | | | | | | | | | |

CONTAB

| | TRN | TRN | RSQ | CONFLICT TYPE | ZONE | ZONE | FLAG |
|---|---|---|---|---|---|---|---|
| 1 | | | | | | | |
| 2 | | | | | | | |
| 3 | | | | | | | |
| 4 | | | | | | | |
| ⋮ | | | | | | | |

FIG 6
TRAIN SCHEDULE
| TRAIN NUMBER | FROM | TO | ARRIVAL/DEPART | ARRIVAL/DEPART/TIME | PRIORITY | OCCUPANCY TIME | PRIMARY DELAY |
|---|---|---|---|---|---|---|---|
| 1 | C | 3 | A | 1805 | 1.0 | 2.1 | 2 |
| 2 | 20 | 7 | A | 1808 | 1.0 | 2.1 | 0 |
| 3 | 35 | 2 | A | 1810 | 1.0 | 1.5 | 0 |
FIG 7
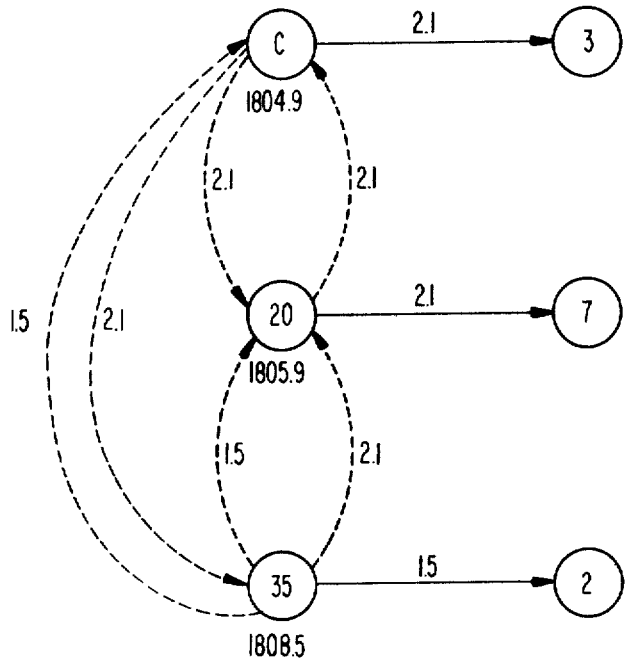
FIG 8
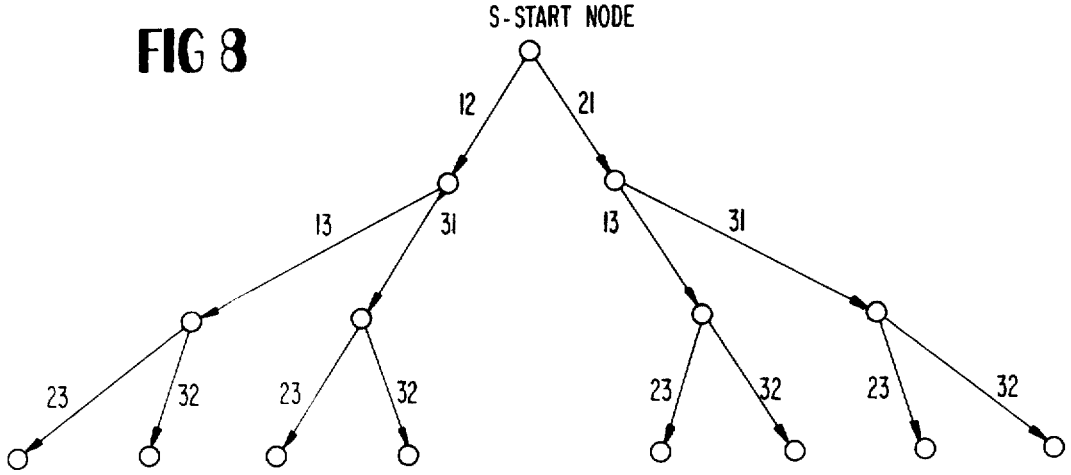

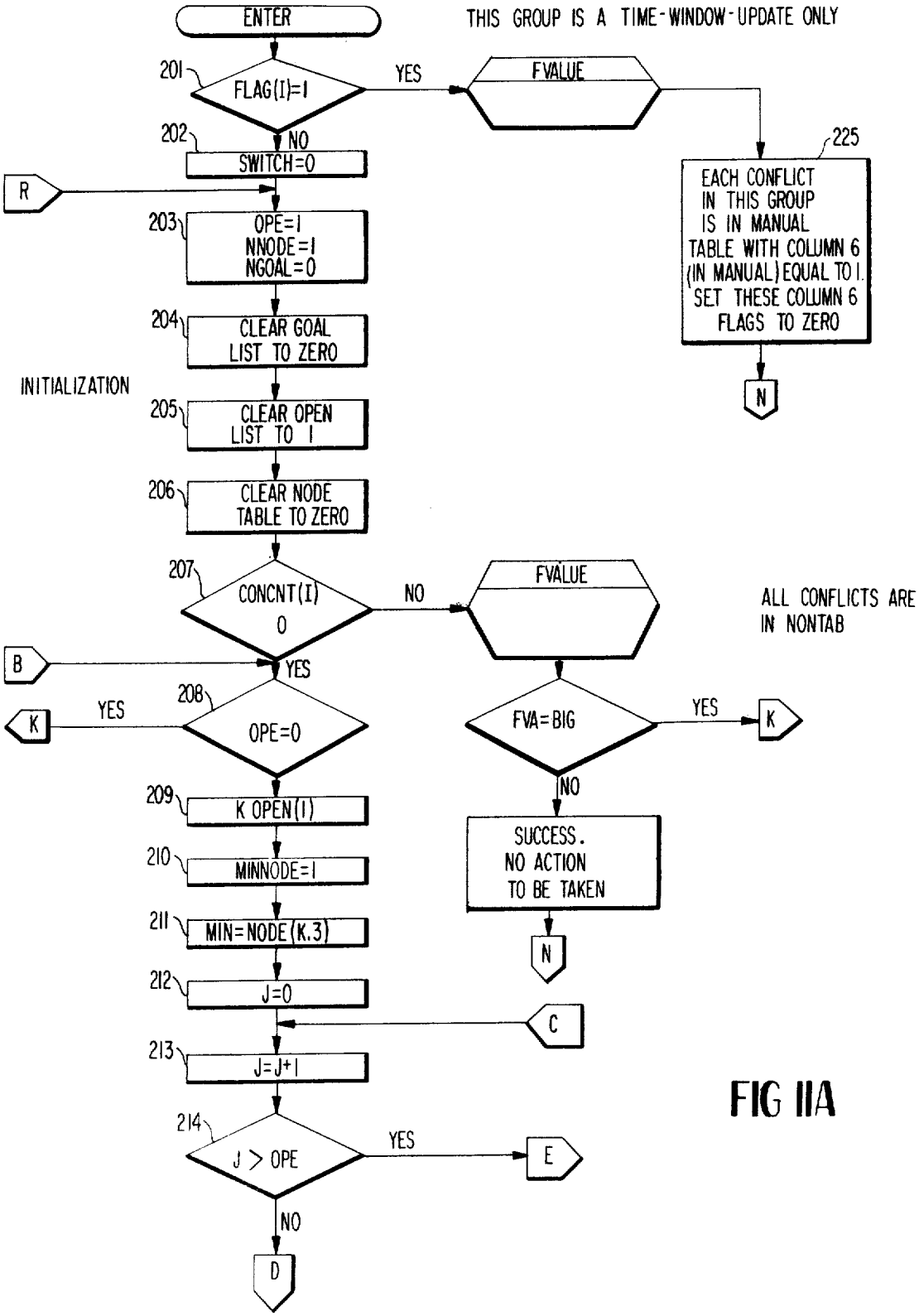
FIG IIA

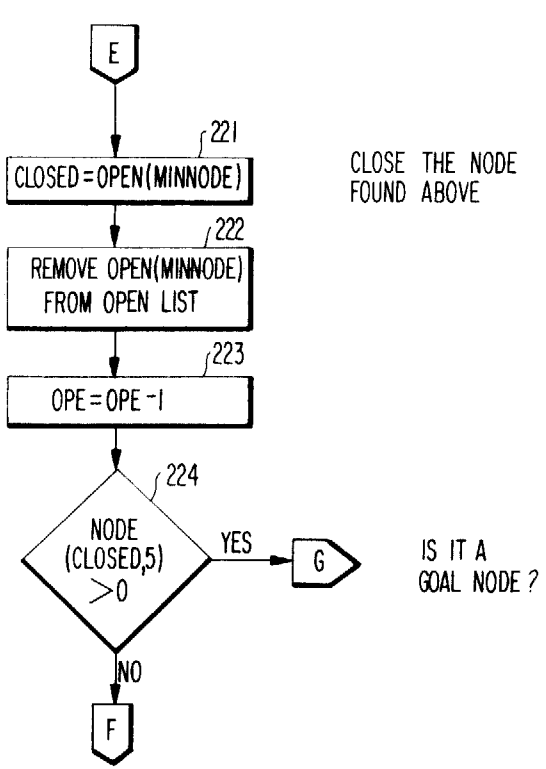
FIG IIC
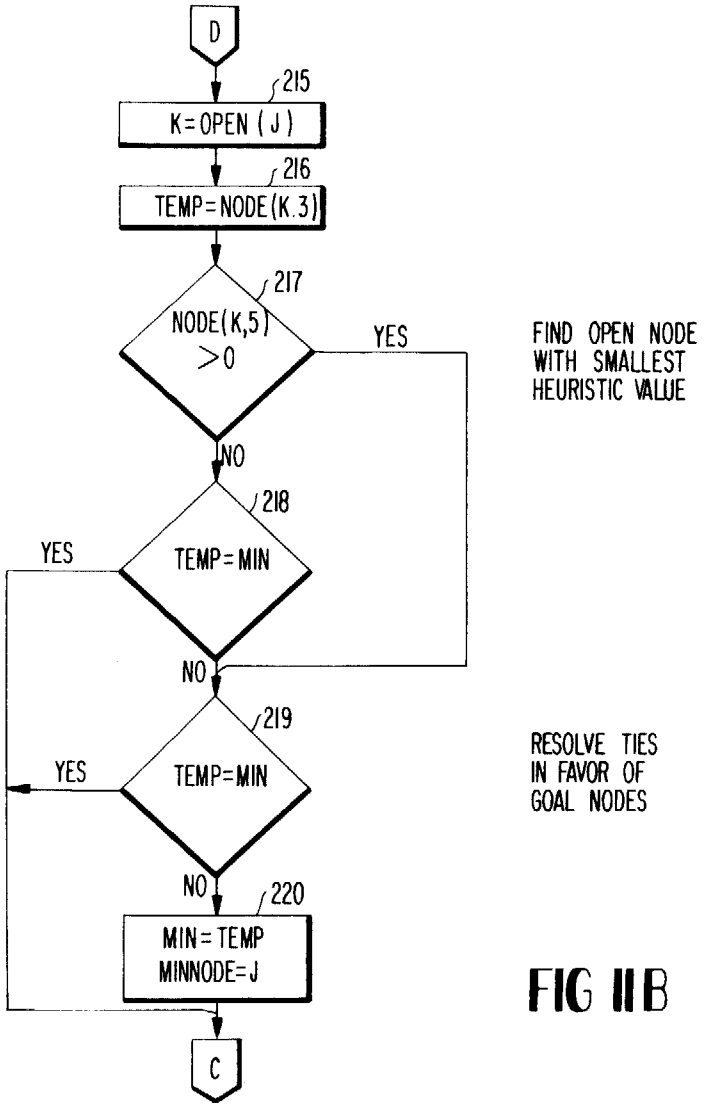
FIG IIB

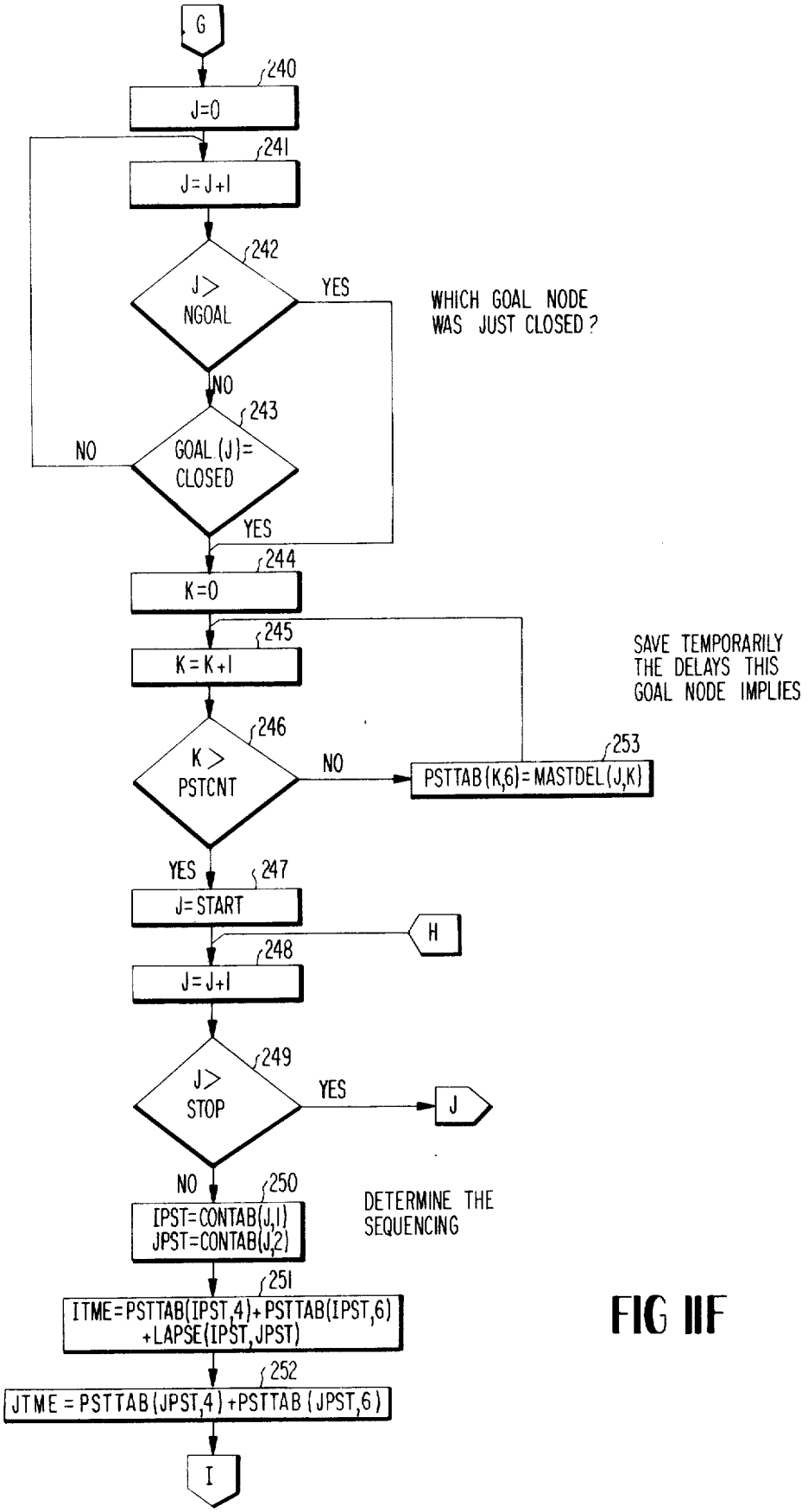
FIG IIF

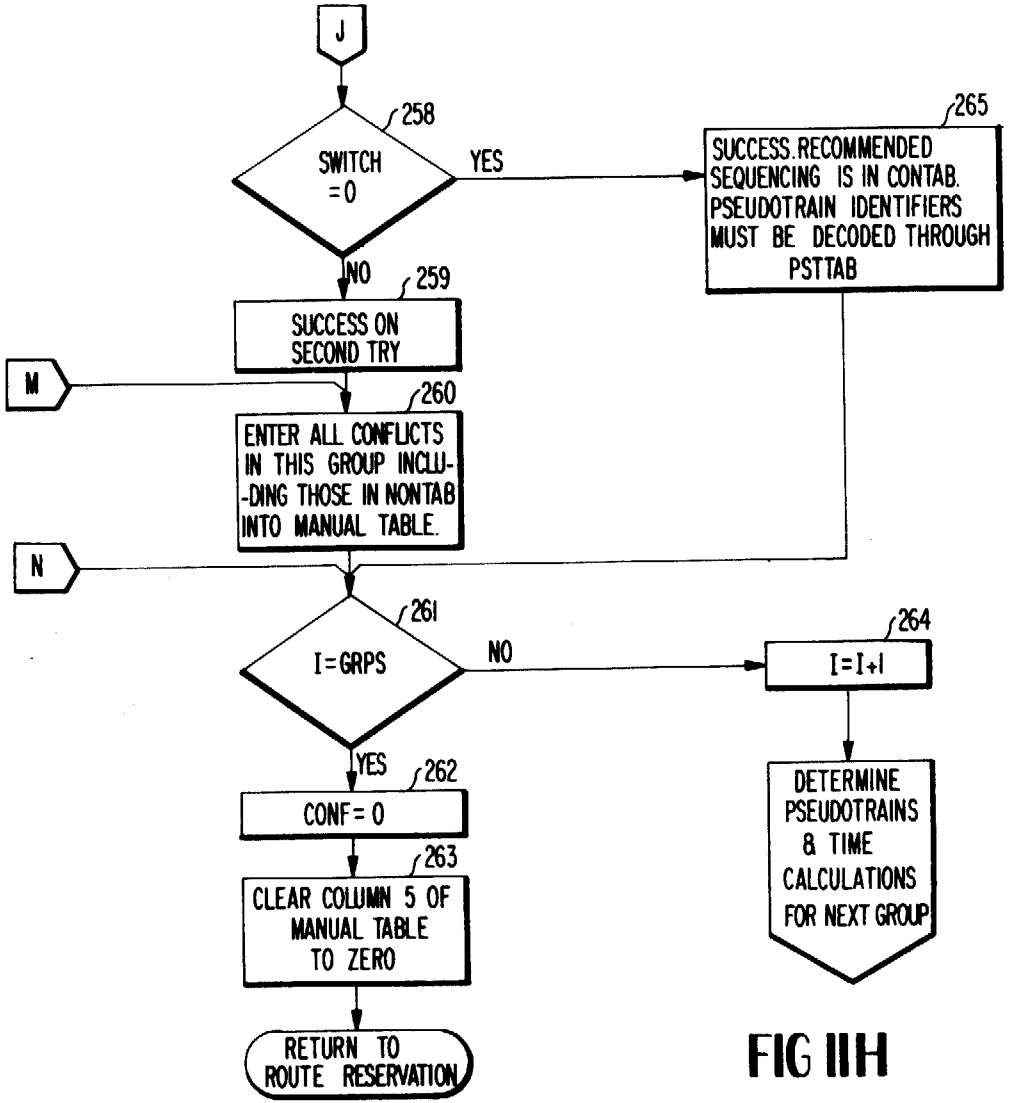
FIG IIH
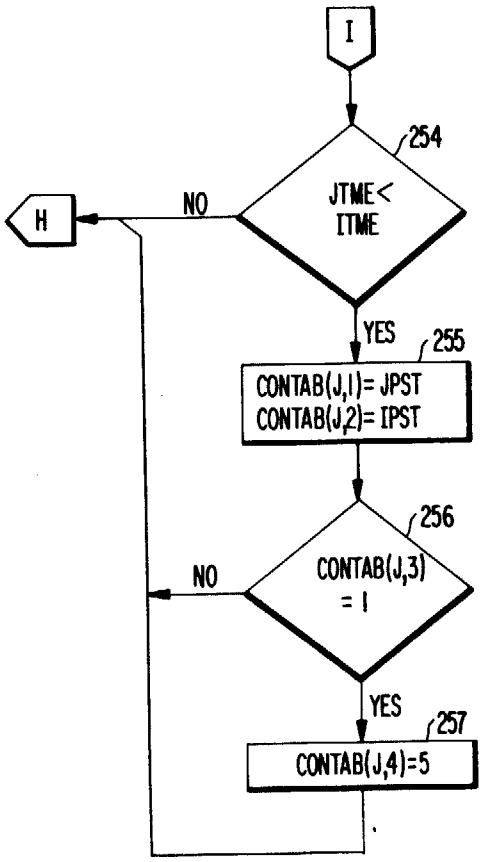
FIG IIG

DETERMINE HOW THE SEQUENCING IMPLIED BY THE CURRENT NODE AFFECTS ANTICIPATED ARRIVAL TIMES

FIG. 12L
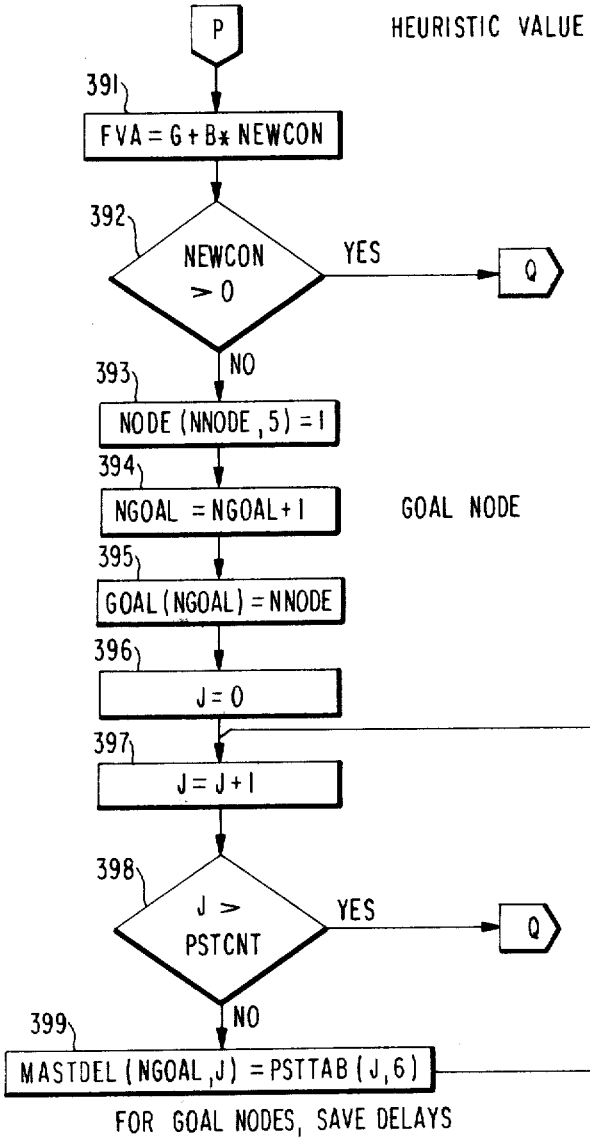
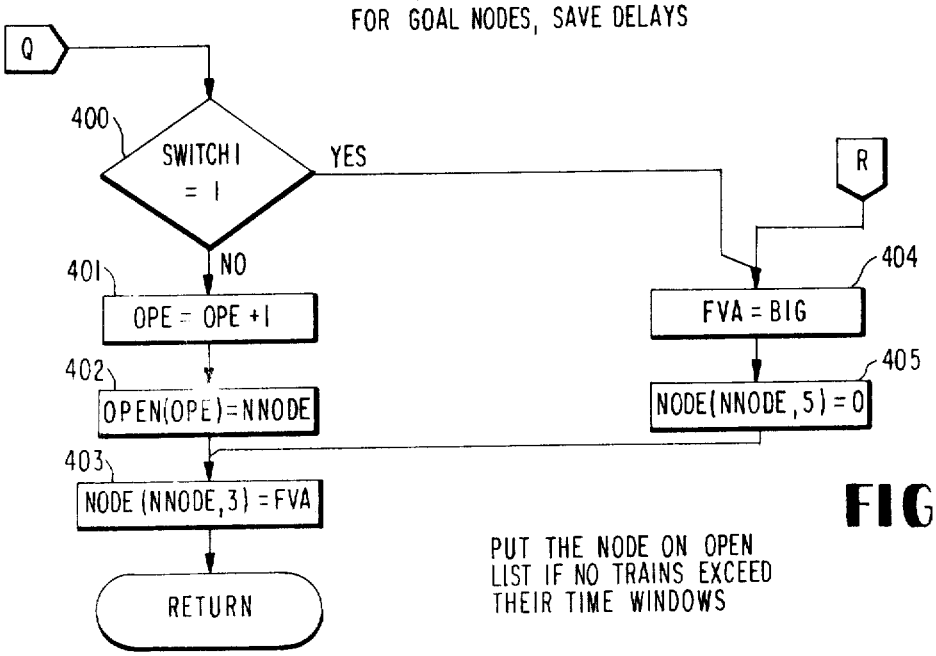
FIG. 12M

ROUTE CONFLICT ANALYSIS SYSTEM FOR CONTROL OF RAILROADS

FIELD OF THE INVENTION

The present invention relates to automated control of railroads, and more particularly, to the automated resolution of conflicts.

BACKGROUND OF THE INVENTION

Automated railroad traffic control systems which include the operations of a general purpose digital computer have been disclosed in U.S. Pat. Nos. 3,838,768 and 3,976,272 both of which patents are assigned to the assignee of this application.

In the first-mentioned patent, a traffic control system is disclosed in which a digital computer is employed to monitor railroad operation, although all initial decision-making operations are left to a human operator. In that system, the general purpose digital computer receives inputs from the railroad area which is being controlled and maintains a description of the condition of the area at all times. The computer also controls a visual display so that the human operator is informed of railroad conditions. Based upon the display, the operator may initiate control requests to alter the condition of the railroad so as to facilitate train movements which he deems necessary or desirable. For example, the operator may clear a signal, request the repositioning of a track switch, etc. The digital computer then monitors the operator's judgments by determining whether or not the operator's control requests are valid in light of existing traffic conditions. For example, the system will prevent the operator from clearing a signal into an occupied track section or throwing a switch which is occupied, etc.

The system disclosed in U.S. Pat. No. 3,976,272 is more sophisticated in that it eliminates the necessity for detailed operator intervention, and can, under certain conditions, make decisions for itself and implement those decisions, automatically. For example, the operator may direct the system to clear a route for a particular train from an entrance to an exit location in the railroad. The system is capable of implementing this request and selecting a preferred route where more than one is available, although the operator does not designate the particular route the train should travel. The automatic route selection is based upon predetermined constraints as well as traffic conditions.

By progressively removing more and more responsibility from the human operator, the systems disclosed in the referenced patents allow the operator to control more comprehensive territory than would have been possible under completely manual conditions. The term comprehensive is employed here to designate either larger and larger geographic areas or areas of greater complexity, or both. As those skilled in the art will realize, increasing the complexity of a railroad area, by for example adding further tracks and switches, or increasing the geographic extent of control, increases the rate at which decisions must be made at the controlling location as well as increasing the factors that must be taken into account in making those decisions.

However, as the number of train movements which must be controlled increases, the feasibility of employing manual control may be seriously questioned, even the minimum manual control required by the systems disclosed in the referenced patents. Furthermore, the system of U.S. Pat. No. 3,976,272 is suitable in situations in which an alternative route is available which is conflict-free or which will soon become conflict-free. The term conflict here refers to any situation in which one route would prevent the setting of another route, for example, where the two routes include a common track section or track switch. While the system of the U.S. Pat. No. 3,976,272 can cope with certain conflicts it is not designed to analyze the various options for effective conflict resolution. It should be apparent that, given a conflict, there is, of course, only one solution; one of the two trains must be delayed to enable the other to move past the conflicting point. Deciding which train to delay is not always simple, as many factors must be taken into account. For example, it is not at all unusual for these factors to include not only factors relating to the particular trains involved in the conflict, but also other trains which would be affected by delaying one or the other of the trains involved in the conflict.

SUMMARY OF THE INVENTION

The present invention meets the problem discussed above in an orderly and logical fashion by improving available techniques to provide for automatic conflict analysis and resolution. In an initial phase, all potential conflicts are determined, in no particular order or sequence. Since the object of the system is to resolve conflicts, and since the only feasible method of doing this is to delay one train in favor of another, train schedule information cannot be relied on to give accurate indications with regard to true conflicts. Therefore, the entire railroad area under control is considered and if the route for any train in that area conflicts in any way with the route for any other train in that area, a potential conflict is determined. Of course, during the analysis phase it may turn out that this is not a true conflict at all, but since such determination cannot be made in the initial phases, the potential conflict must be examined. Furthermore, it is inadequate to merely consider those trains actually within the area to be controlled, for trains just outside this area may well have to be taken into account. Therefore, the trains considered in determining and resolving conflicts are those which are actually within the area of control as well as those within a predetermined time of entering that area. Thus, conflicts can simply be determined by listing each railroad element in the route for that train and comparing that list with each railroad element in the route for each other train. Any coincidence produces a potential conflict and the system builds a conflict table, listing information regarding each potential conflict.

In the next phase of conflict resolution, the conflicts are put into a logical order; in other words, the different conflicts are grouped with regard to those conflicts which must be considered as a unit. For example, in resolving a conflict between trains A and B, the most feasible solution might appear to be delaying train A in favor of train B. However, delaying train A in favor of train B could produce a conflict between train A and train C. Clearly, if this is the case, all three trains should be considered together for conflict resolution. Thus, in the second phase of solution, conflicts are grouped into groups which include all trains which must be considered in the resolution of any conflict within the group.

In the third, and succeeding phases of the conflict resolution, the now separately formed groups are considered separately, and in turn. Taking up a first group, each of the trains identified in that group is broken down and identified as a different pseudo-train for each potential conflict. This grouping builds a table called a pseudo-train table (PSTTAB) which is then ordered in a logical sequence in which the farthest upstream pseudo-train corresponding to any particular train is listed first, followed by any other appearance of that train and so on.

In the next phase of conflict resolution, a lapse table (lapse) is built for each conflict involving different trains. The lapse table has entries as to the time that one train must be delayed to allow another to precede it through a conflict zone. This information will be utilized in later portions of the solution.

With the information now obtained and assembled, the system can proceed to the task of conflict resolution. In order to perform its task within reasonable constraints of processing power, storage space and time, the system employs a heuristic search technique rather than employing the brute force approach of reviewing each potential conflict resolution and determining the one which is least disrputive. Just as the case with the determination of pseudo-trains and the building of the lapse table, the heuristic search is carried out only within a conflict group. In order to order the potential conflict resolutions in terms of desirability a "cost" is assigned to each possible solution. The "cost" is based mainly upon the delay added to resolve conflicts but is also proportional to train priorities, i.e., it may be less disruptive to a system to delay a given train by one minute than to delay another train by 30 seconds.

Each potential conflict resolution may depend upon the resolution of a plurality of intermediate conflicts. To employ the heuristic search method, it is necessary to have some procedure to select those intermediate conflict resolutions which appear to be the most desirable. To effect this, each intermediate conflict resolution is examined and is assigned a "cost". This "cost" is made up of two components, the first is related to the "cost" implied by the particular intermediate conflict resolution being examined. This "cost", for each intermediate conflict resolution, is the product of the delay imposed by the conflict resolution and the value of the train priority on which this delay is imposed, multiplied by a constant. The second component is a measure of the remaining number of conflicts that must be resolved in order to resolve all the remaining conflicts in the group. This estimate is merely the sum of the remaining conflicts to be resolved multiplied by a suitable constant. Thus, for each intermediate conflict resolution analyzed, a quantity is associated therewith termed the "F" value, which is the sum of the above-defined components. Each intermediate conflict can generally be resolved in either of two ways; for example, train A preceds train B or train B preceds train A. Using the technique described above, a cost is determined for each of these potential resolutions, and analysis proceeds following the path of least cost.

If all conflicts in a single group can be resolved in this fashion, then the problem has been successfully solved and the system has identified, for example, which of the trains involved in each conflict should precede the other, and in addition, the amount of delay that should be imposed on the other train.

To take account of operations outside the controlled area, each train has an associated time window setting the maximum delay that can be imposed on the train. A proposed conflict resolution exceeding this will be denied. This requires selection of alternative conflict resolutions until the successful solution is obtained.

Finally, there is no guarantee that a successful solution of the problem will be obtained within all the constraints imposed on the system. In one embodiment of the invention, the system is configured so as to not violate any constraint, but instead to present this problem to an operator who determines which one of the constraints should be violated in order to obtain a conflict-free ordering of routes.

BRIEF DESCRIPTION OF THE DRAWINGS

A preferred embodiment of the invention will now be described in conjunction with the attached drawings, in which:

FIG. 6 shows a typical schedule for three train movements which may conflict;

FIG. 7 is a graphical illustration of the movements;

FIG. 8 is a tree diagram illustrating potential resolutions;

FIGS. 11A–11D and 11F–11I illustrate the routine SEARCH forming part of function 110 in FIG. 5A; and FIGS. 12A–12M illustrate the routine FVALUE forming part of function 110 in FIG. 5A.

DETAILED DESCRIPTION OF THE INVENTION

Inasmuch as the present invention is, in some aspects, improvements of the systems disclosed in U.S. Pat. Nos. 3,976,272 and 3,836,768, the specific disclosure of those patents will not be repeated herein, unless it is important to an understanding of the invention, and accordingly, the disclosure of the referenced patents are incorporated herein by reference. We will therefore not discuss the manner in which communications are carried out between the railroad area and the control office, nor will we discuss how the system interprets indications received from the field, the manner in which the railroad configuration is modelled at the control office, nor the manner in which controls, which have been selected from transmission, are stored and later read out and transmitted.

Figure 1:
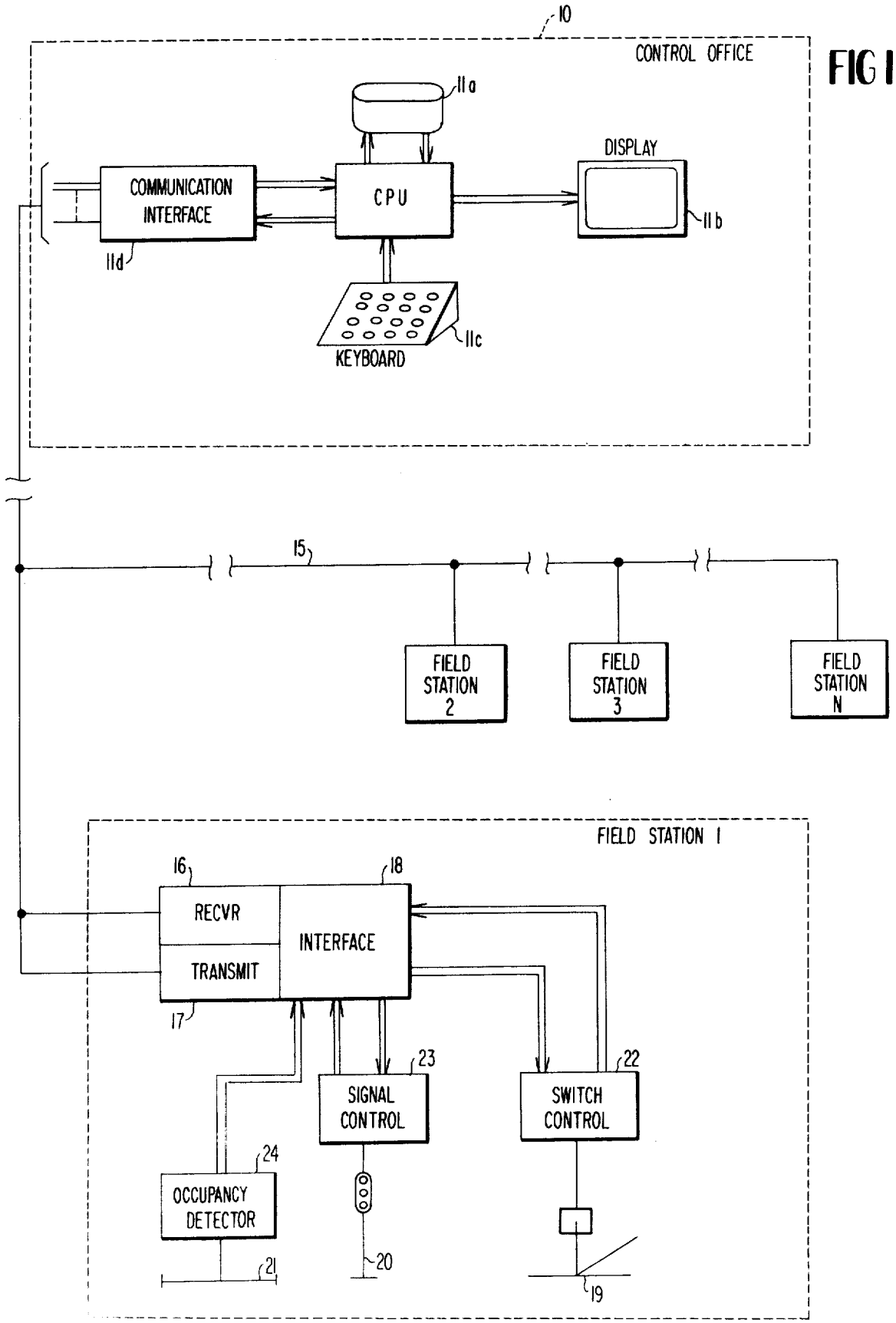
FIG. 1 is a block diagram of a typical system.

In order, however, to obtain an overall understanding of the comprehensiveness of the system, embodying our invention, reference is now made to FIG. 1, which illustrates a control office and typical field station as well as the relationship of that apparatus with still other field stations. More particularly, a control office 10 is illustrated as being connected to a duplex communication channel 15. Apparatus at the control office includes a central processing unit 11 associated with a plurality of peripheral devices. In particular, a mass memory device, which may comprise, for example, a drum or disc 11A is illustrated, along with a visual display 11B, as well as a typical input device, shown in FIG. 1 as a keyboard 11C. Finally, an I/O communication interface 11D is provided to connect the foregoing apparatus to the communication channel 15. Also connected to the duplex communication channel 15 are a plurality of field stations. The apparatus at a typical field station includes a receiver 16 and transmitter 17, both of which are connected to an interface 18. The railroad elements associated with any particular field station may vary, and illustratively shown in FIG. 1 are track switch 19, signal 20 and track section 21. Information is derived from the track switch 19 through a switch control 22 and provided to the interface 18 for transmission to the control office. Information is also provided from the signal 20 through a signal control 23 to the interface 18, and likewise an occupancy detector 24 responds to information from the track section 21 and provides the same to the interface 18. Signals such as these, termed indications, are communicated by the receiver 16 through the communication interface 11D to the central processing unit 11 for later use. Information travels in the opposite direction, termed controls, through the communication interface 11D, receiver 16, interface 18, and signal control 23 or switch control 22 to control either the conditioning of signal 20 or the positioning of switch 19. The referenced patents also teach the manner in which indications received from a plurality of field stations are stored, interpreted and the manner in which controls, generated by the CPU 11, are transmitted, received and acted on.

Figure 2:
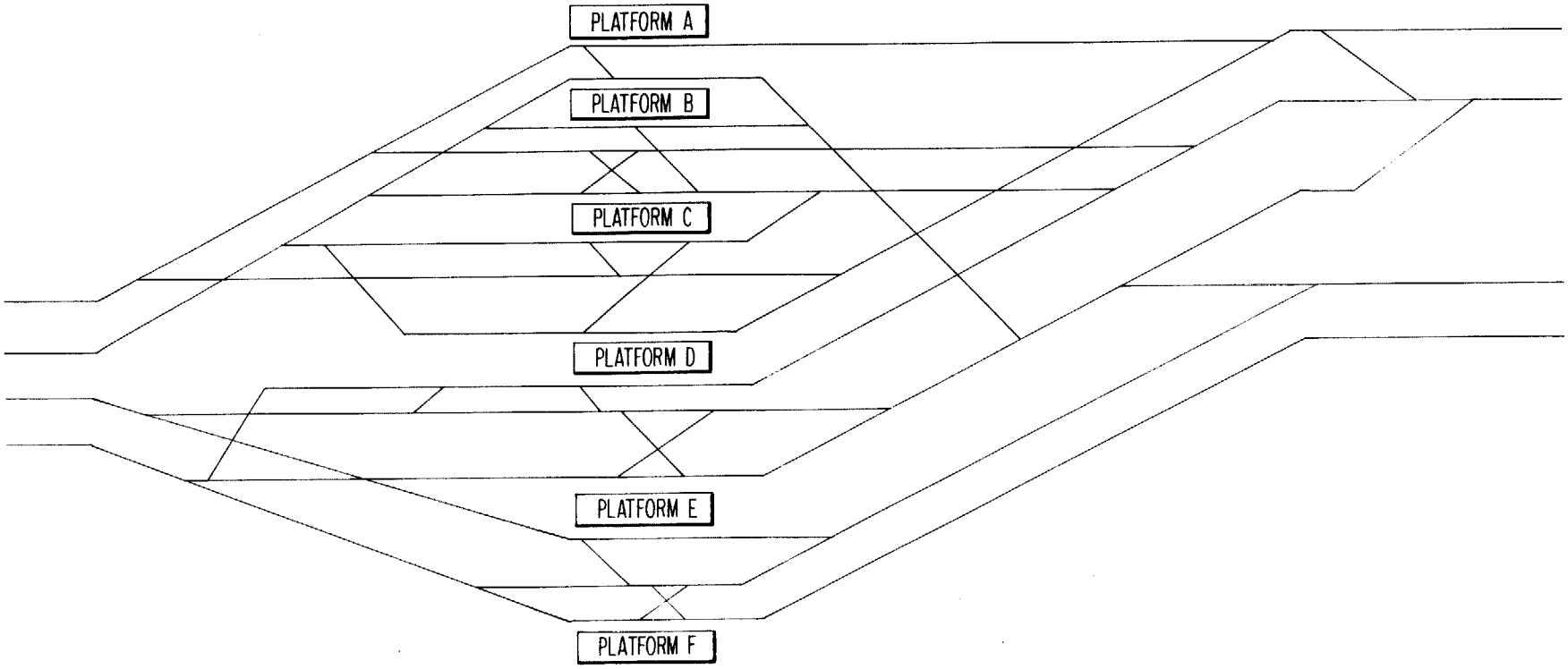
FIG. 2 is a track plan of the type that the system can control.

As discussed in the preceding portions of this specification, the apparatus of our invention is particularly useful when road operations become so complex that it is difficult or impossible for an operator to keep up with them and make the required judgments. One embodiment of our invention is destined to be applied in complex railroad interlockings. FIG. 2 illustrates a typical such interlocking in which a host of track switches interconnect a plurality of tracks and allow for a plurality of routes from any of a number of entrance tracks of the railroad area to one of a plurality of intermediate destinations. For example, a train entering at either end of this interlocking area can travel over several different routes to an intermediate destination such as one of platforms A–F. Likewise, on departing a platform, the train may take one of a plurality of routes to any of the exit tracks in the railroad area. Because of the great interconnectivity, those skilled in the art will readily understand how several simultaneous moves can rapidly lead to a situation which is difficult to resolve. For example, with an interlocking of the complexity shown in FIG. 2, and with traffic requiring upwards of 3,000 train movements per day, one can understand how it may be difficult or impossible for an operator to rationalize the different movements, especially when he must further take into account a plurality of other factors.

Because the system of our invention will ordinarily not be employed to control an entire railroad, it will thus not have information regarding inter-relationships beyond the boundaries of control. To take those inter-relationships into account, each train has further associated with it a so-called time window, i.e., a period of time in which it must travel over the desired route. This is a further constraint on the system because the delay imposed on a train, in order to resolve a conflict, must not be such as to cause a train to violate its time window.

The executive routines, as well as the input/output routines necessary for making effective the decision made by the operating system, are disclosed in the referenced patents and will not be repeated herein. When potential conflicts are to be resolved, the routine ROUTE CONFLICT ANALYSIS is called. At this time, the system has already built the main conflict table, CONTAB.

In addition to the tables disclosed in the referenced patents, particularly the '272 U.S. Pat. No. 3,976,272 the system also includes information respecting the railroad schedule, see FIG. 3. Most railroads run on a schedule or time table basis, although because of practical reasons, it is not unusual to encounter trains which are either ahead of or behind schedule. In fact, if the railroad could be kept perfectly to schedule, there would not be any need for our invention for it would only be necessary to work out a conflict-free schedule.

Furthermore, the system has knowledge of the running time for trains of various lengths and performance characteristics through the several sections of track that will be controlled. For refining operations, the information may further be provided as a function of signal aspect.

CONTAB (See FIG. 4) includes a row for each conflict and several columns to contain the following information:

Column 1 includes the identifier of the first train in the conflict;

Column 2 includes the identifier of the second train in the conflict;

Column 3 is a re-sequenceability indicator which, for example, could contain information as follows:

0—re-sequenceable

1—re-sequenceable only with approval

2—non-re-sequenceable

3—non-re-sequenceable: sequence set manually

Column 4 includes type of conflict, for example, 0—pure conflict, 1—connection dependency, 2—common track usage, 3—hardware dependency, and 4—common entrance or common exit;

Column 5—identifier of the conflict zone for the first train;

Column 6—identifier of the conflict zone for the second train; and

Column 7—a flag to indicate that the conflict was entered manually, for example, 0—not entered manually, 1—entered manually.

The production of a table such as that referred to above, should be apparent to those skilled in the art. However, reference is made to U.S. Pat. No. 3,976,272 and, more particularly, to FIG. 13B therein which illustrates the subroutine EXTK 1. This portion of the subroutine is attempting to build a route for a train, and functions 1311–1313A determine that the element sought to be included in the route is already selected for another route. This is one indication of how a conflict can be determined. Once this is established, the train identifications are known as well as the location of the conflict, type of conflict and therefore, re-sequenceability. From this, it is a simple matter to make the proper entry into the table. This is one example of how the table could be constructed, although, of course, those skilled in the art will understand that other procedures could also be used.

The other factors making up CONTAB include the resequenceability indicator and conflict type. In general, conflicts created by the aforementioned can be grouped into three basic categories:

Common Entrance Conflict—two or more trains share the same entrance point and the sequence of train moves is fixed;

Common Track Usage Conflict—two or more trains share a common exit point or one train must move over a defined point within the route of another train;

Pure Conflict—two or more trains require the same section of track (other than an entrance or an exit point). The length of the shared track can vary from a simple crossover to several kilometers. The solution of conflicts requires imposition of added delays to one or another train.

However, before delays can be imposed on any train, any dependencies between two or more trains must be determined.

A dependency exists whenever one train is restricted in some way by the actions of another. Three types of dependencies are:

Sequence Dependency—one train is in conflict with another in such a manner that fixes their order. (Both common entrance and track usage conflicts fall into this category.)

Hardware Dependency—two train moves share the same rolling stock. Although it may be physically possible to resequence these moves under some conditions, the system considers their order fixed. Resequencing must be generated by the operator.

Connection Dependencies—departure of a train is delayed until one or more other trains arrive to allow passengers time to make connections. The system attempts to honor connection dependency delays, however, if a previously determined offset is exceeded, the train is allowed to depart immediately. Exception to this occurs for large offset times (greater than 7), such as one typical for the last connections of each day. If such a dependency must be broken, the operator must intervene. Based on the above definitions, a pure conflict would nomally be re-sequenceable, while the other two conflicts are not. Hardware dependent trains can only be re-sequenced with operator approval, etc.

Figures 5A, 5B, 5C:
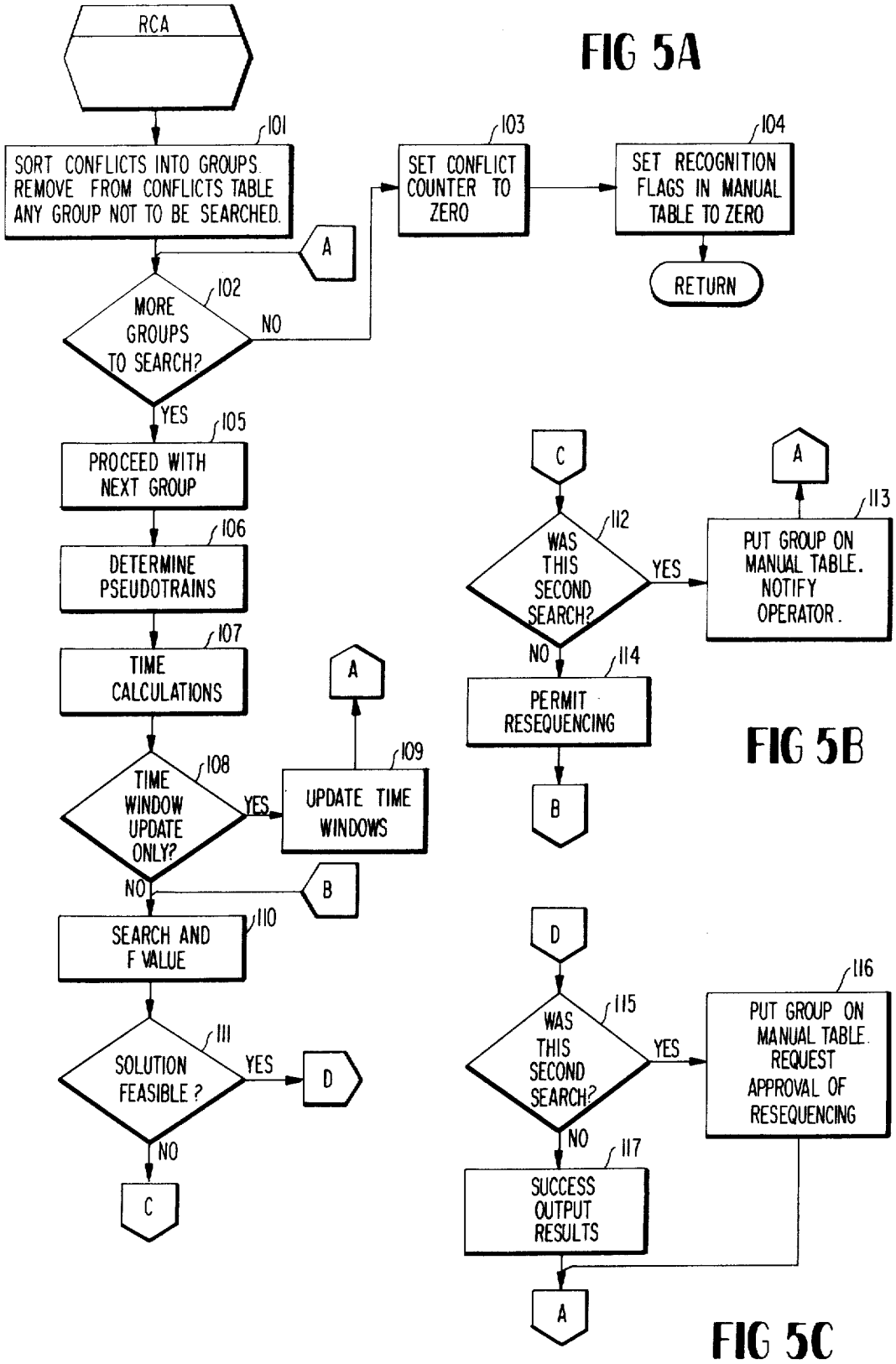
FIGS. 5A, 5B and 5C illustrate the gross functions performed in the system.

The first step 101, as shown in FIG. 5A, is to sort the conflicts in CONTAB into groups. Since the processing is simple, it will not be further discussed except to say that each entry in the conflict table refers to two trains. In beginning the sorting, one train identity is employed as a comparator and other entries in the conflict table are reviewed to determine the occurrence of this train. Any such conflicts thus belong in the same group. The same steps are carried out for each different train, sorting all the conflicts into as many different discrete groups as possible. Of course, each of the conflicts in one group would not involve a train in common with any conflict in any other group. Once the conflicts are thus sorted, step 102 determines if there are any groups still unprocessed. In step 101, the number of conflict groups are stored in a counter, and as the groups are processed in turn, the counter is decremented so that step 102 merely requires reference to the counter to indicate whether or not it is non-zero. Assuming we have not searched any of the groups yet, the counter would, of course, not contain a zero count and we would then proceed to step 105 which is a selection of the next group for processing. Step 106 determines pseudo-trains and makes entries into the pseudo-train table, PSTTAB. This table has a row for each pseudo-train (to be defined), and several columns as follows:

Column 1 is the pseudo-train identifier;

Column 2 is the conflict zone identifier for the pseudo-train.

Each different combination of train and conflict zone gets a different pseudo-train identification. Column 3 has a link showing the next down-stream occurrence of a pseudo-train identified with the same train as this pseudo-train. Column 4 has the anticipated time that this train will arrive at the conflict zone. Several additional columns are employed as work space area.

The logic for providing this table is relatively simple. The first conflict is examined and a train and zone of that conflict become the first pseudo-train with appropriate entries made in appropriate columns of the pseudo-train table. As other trains in the same conflict group are examined, different pseudo-trains are created with appropriate entries in the table. By referring back to the train from which any given pseudo-train was derived links between different pseudo-trains of the same train are created, for filling column 3. Column 4 does not, at this time, have any entries therein.

Function 107 performs certain time calculations for both making appropriate entries in column 4 of PSTTAB, as well as a new table entitled LAPSE. This latter table has a row for each pseudo-train and a column for each pseudo-train. An entry, which corresponds to, for example, LAPSE (I, J), is located in the row in the lapse table for pseudo-train I and the column, in the same table, for pseudo-train J. This entry defines the amount of time which must pass before pseudo-train J may proceed if pseudo-train I is allowed to go first. That is, assuming pseudo-trains I and J arrive at the conflict zone simultaneously, this is the time that must pass before J can proceed. Likewise, the entry to LAPSE (J, I) is the amount of time which must pass before pseudo-train I may proceed if pseudo-train J is permitted to go first.

When the route conflict analysis subroutine is entered, the identity and location of all trains to be considered is known. In addition, the system has available to it tables defining the occupancy time for each zone. This allows computation of the primary delay which is the delay that the real train is exhibiting in real time. Knowing the primary delay, the scheduled arrival time and location, we can obtain the expected arrival time by simply adding the primary delay to the scheduled arrival time. With this information and the expected zone occupancy times of the different zones we can, by further arithmetic, compute the expected arrival time of the train at the conflict zone. This information is, of course, first entered into the pseudo-train table, column 4, for the appropriate pseudo-train. This is also the beginning of the computation for the LAPSE table entries. If both trains arrive at the conflict zone at the identical time, the LAPSE entry (I, J) is merely the time it will take the pseudo-train I to clear the conflict zone, for it is this amount of time by which train J must be delayed to allow train I to precede it. The corresponding entry for the LAPSE table for location (J. I) is then merely the occupancy time of the conflict zone for pseudo-train J. On the other hand, if either train I or train J arrives at the conflict zone first, the preceeding quantities will have to be modified to take this into account. For example, if train I reaches the conflict zone 12 seconds prior to train J, then the entry at location (I,J)is 12 seconds less than the occupancy time of the conflict zone for pseudo-train I. The corresponding entry at (J, I) is then 12 seconds more than the occupancy time of train J in the conflict zone.

Before describing the analysis that now takes place, it is believed worthwhile to describe a simple solution to illustrate the basis on which the system operates.

DESCRIPTION OF PROBLEM SOLUTION

Figures 3, 4, 10:
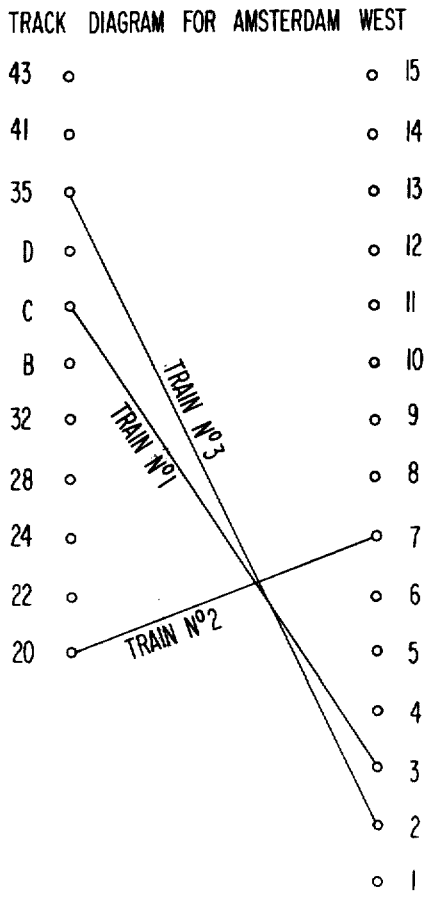
FIG. 3 is a schematic showing of SCHEDULE information layout.
FIG. 4 is a schematic showing of the table CONTAB.
FIG. 10 is a diagram illustrating the three movements of FIG. 6 in a different form.

For a given set of train movements which are required to be executed, along with the time relations between them, the goal is, of course, an ordering of movements which minimize delay to the system. The set of required train movements and the time relations between them can be displayed graphically as a net where the nodes are the train movements and the time relations are arcs. FIG. 10 is a graphic description of three train movements, train 1 moving from track C to platform 3, train 2 moving from track 20 to platform 7 and train 3 moving from track 35 to platform 2. FIG. 6 illustrates a schedule for these moves wherein the train identifications given in column 1, the beginning point of the move is given in column 2, the destination is given in column 3, whether the train is an arrival or departure is defined in column 4, the arrival or departure time is given in column 5, the train priority is given in column 6 (the meaning of this will be explained hereinafter), the occupancy time the train is expected to exhibit in making the move is given in column 7, column 8 gives the primary delay.

The primary delay is that delay exhibited by the real train and must be subtracted from the time window to find the maximum delay that can be imparted to the train as a result of conflict resolution.

FIG. 7 discloses much the same information in a slightly different form. The destinations, that is, platforms 3, 7 and 2, are shown at the right, the initial location of the movement for each of the trains is shown at the left. The quantity above the horizontal arrow directed to the right is the occupancy time. Taking up the movement from track C to platform 3 (train 1) we can determine that the scheduled arrival time is 18:05 and since the train has a primary delay of two minutes, its expected arrival time is 18:07. Since the train is expected to occupy the zone between track C and platform 3 for 2.1 minutes, we can expect train 1 to arrive at track C at 18:04.9. Likewise, working back from the arrival time for trains 2 and 3, we can see that train 2 is expected to arrive at track 20 at 18:05.9 and train 3 is expected to arrive at track 35 at 18:08.5. The dashed arrows define the delays that must be provided between one movement and another. For example, if train 1 proceeds first, then 2.1 minutes must be allowed train 1 to complete its move before train 2 is allowed to proceed. On the other hand, if train 3 is allowed to proceed first, we need only delay train 2 for 1.5 minutes.

The object of the conflict resolution system is to determine from this information what ordering of train movements will be least disruptive to the system.

One technique that could be employed is a brute-force technique in which analysis is made for each possible permutation and combination of train movements. This is graphically displayed as shown in FIG. 8 in which the nodes are decision points or points at which a judgment must be made and the arcs, which are numbered, define which trains move ahead of which other trains. For example, starting at S there are obviously two possibilities, either 1 can proceed before 2 or 2 can proceed before 1; thus, we show two arcs, one labelled 12 and the other labelled 21. In this fashion, each possible combination is laid out and the system can then analyze by starting at a goal, that is, one of the nodes in the lower part of the Figure, and working back determine the delays implied by the train ordering. While in principle this would provide a solution, practical limits on time, storage availability and processing power require more efficient alternatives. The system of our invention employs a heuristic search. In this procedure, as each of the nodes is generated, beginning at the start node, they are ordered in terms of most efficient conflict resolution. The search then expands outward through those arcs which are thought to be most promising. In order to apply this technique, however, we need a measure to evaluate one node as opposed to another, and for this measure we determine an evaluation function, $f(n)$, for each node.

Figure 9:
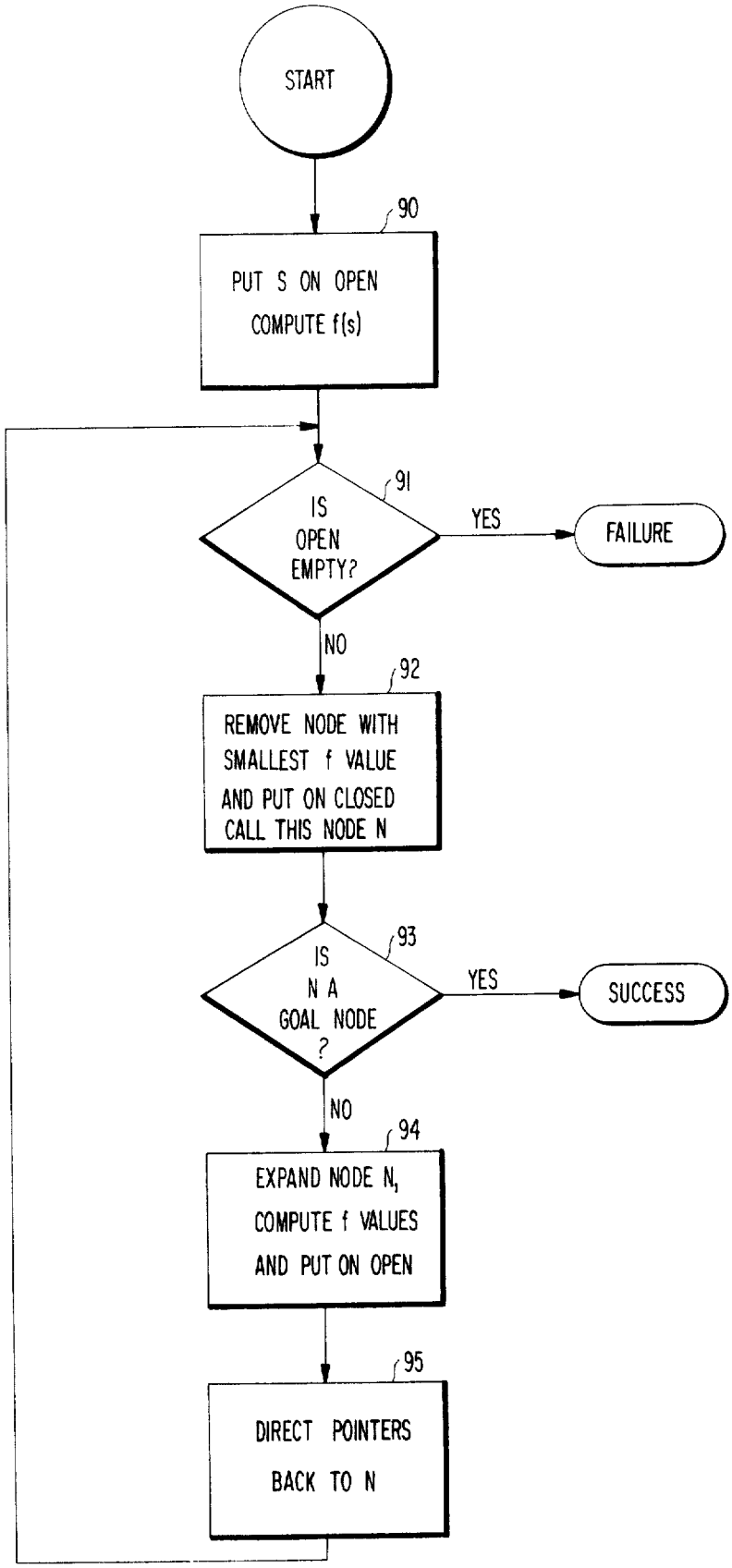
FIG. 9 is a flow chart for the heuristic search technique.

FIG. 9 illustrates a simple technique to implement this search. From the start, step 90 selects a node, puts it in a list called OPEN, and computes the evaluation function. The next step 91 determines if the list OPEN is empty. On the first pass through this routine, since we had just put a node on OPEN, it would not be empty, and we would proceed to step 92, where we remove the node with the smallest $f$ value, and put it on a list called CLOSED and refer to this node in the future as N. Step 93 determines if N is a goal node, that is, having made the decision implied by goal N, are there any further conflicts to be resolved. Assuming that there are, step 94 expands node N, that is, determines the characteristics of two further nodes directly descendant from node N, computes their $f$ values and puts them in the list OPEN. Step 95 then directs pointers back to node N so we can relate the newly-expanded nodes to the node that originated them. We then look back to function 91 where we determine if the list OPEN is empty. Assuming it is not, we again select a node with the smallest $f$ value and continue in this loop until we either reach a goal node, or determine at function 91 that list OPEN is empty and exit with a failure.

Of course, the evaluation function is critical to the successful implementation of this technique, since a proper evaluation function will discover a successful route while minimizing the time expended in the search. In the system of our invention, the evaluation function is defined as follows:

$$f(n) = A \cdot g(n) + B \cdot h(n)$$

where $g(n)$ is an estimate of the "cost" from the start node $s$ to the node $n$;

and $h(n)$ is an estimate of the "cost" from the node n to a goal node.

The characteristic of the system that the process seeks to minimize is the added disruption or added delay. Therefore, we determine $g(n)$ as equal to $$\sum_{i=1}^{n} A_i P_i$$

where $P_i$ is a priority value associated to the train and $A_i$ is the added delay required for that train due to the assumed ordering of movements at the node.

The second portion of the evaluation function $h(n)$ is determined as a number equal to the number of real conflicts whose resolution is required between the node $n$ and a goal node. Once each of the factors $g(n)$ and $h(n)$ is determined, the evaluation function is computed as $f(n) = A \cdot g(n) + B \cdot h(n)$. The multipliers A and B can best be selected empirically. Setting $B = 0$ results in a blind search in which every node is evaluated. Setting $A = 0$ leads to choosing a path through the least number of nodes. By properly selecting the relative values of A and B, an efficient search which guarantees an acceptable solution can be obtained.

Returning now to a description of a preferred embodiment, FIGS. 11A through 11I, when taken in conjunction with FIGS. 12A through 12L, illustrate, in detail, the functions performed by function 110 (see FIG. 5A). Actually, the steps illustrated in FIG. 11A through 11I include a subroutine F VALUE, and the latter routine is illustrated in FIGS. 12A through 12L. The preceding discussion, relating to FIG. 5A, discusses the condition of the processor when the route conflict analysis routine is called as well as steps 101–108 carried out in preparing to make the search for a resolution of the conflicts. We will now discuss the steps which allow the processor to make that resolution, with reference to FIGS. 11A through 11J.

Referring first to FIG. 11A, the functions 201 through 206 initialize various counters and registers.

Function 201 checks FLAG (I) to see if it equals 1; later in this description we will discuss when that is the case. In the normal course of events, however, the condition is not met, and the routine proceeds to function 202 wherein a register called SWITCH is set to zero. In functions 203, 204, 205 and 206, registers OPE and N NODE are set to 1, register N GOAL is cleared to zero, the Goal List and the NODE table are cleared to zero and the OPEN list is cleared to ones. Function 207 determines if the register CONCNT (I) is greater than zero. This register contains the number of conflicts in the group being examined (i.e., Group I) and assuming unresolved conflicts this count would not be zero. Function 208 checks the register OPE for zero, and since function 203 set it equal to 1, it would not be equal to zero. Functions 209 through 211 set certain registers: register K is set to the value of the first entry on the OPEN list (which is 1), the register MINNODE is set to 1, and the register MIN is set to the value found at NODE (K, 3). This is merely the value in the NODE table at the location (1, 3) (since the K register has the value unity). The NODE table is a description of the tree (such as that shown in FIG. 9), which has a row for each node and several columns: column 1 contains identification of the predecessor of the current node, column 2 identifies the conflict to which the node belongs, column 3 contains the heuristic value of the node as will be determined by the routine FVALUE; columns 4 and 5 are one-bit FLAGS whose use will be made clear hereinafter.

Figure 11D:
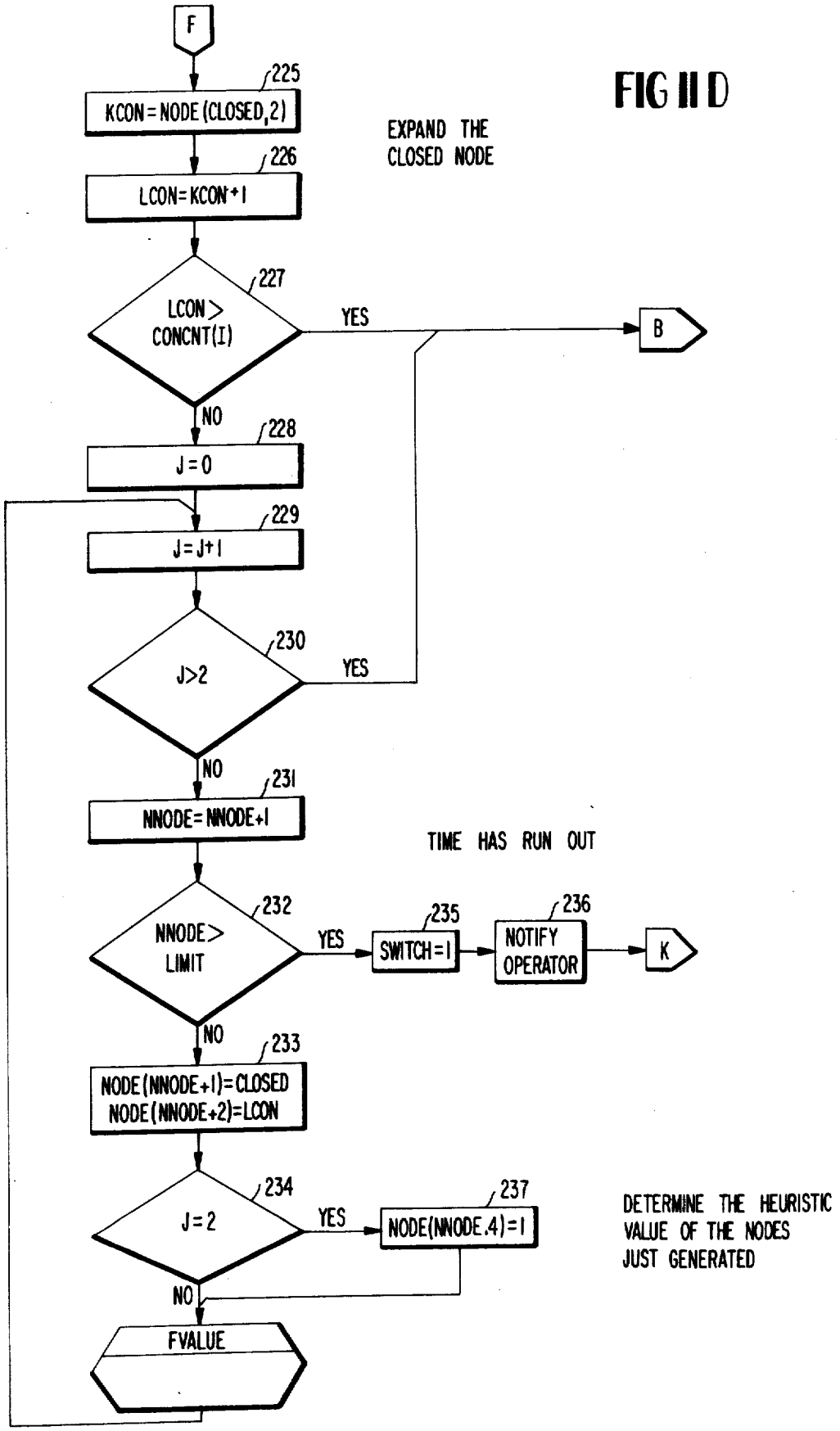

Since the NODE table was cleared to zero (function 206) the register MIN will be set to zero by function 211. Functions 212 and 213 establish a parameter J equal to 1, and function 214 determines if J is greater than OPE. At this point in the routine it is not, and therefore functions 215 and 216 are performed in which the register K is set to OPEN (J). This does not change the value of this register at this time, and a further register, TEMP, is set to the value found in the NODE table at location (K, 3)—which is also zero. Function 217 determines if the value found at the node table location (*k*, 5) is greater than zero. This is the specification for a goal node, and since that location contains a zero, we next determine at function 218, whether TEMP is equal to MIN. Since it is, the routine looks back to function 213 and increments the J value from 1 to 2. At this point, function 214 determines that J is greater than OPE and we proceed to function 221 where the register CLOSED is set to OPEN (MINNODE), that is, the value in the OPEN list at the location MINNODE (which is 1). In this portion of the routine, we are closing the node that had the lowest FVALUE. At this point, since the first node is a dummy we are actually still initializing the system. Function 222 removes this node from the OPEN list and decrements the register OPE. At function 224 we determine if the node we have just closed is a goal node, and under the conditions we have assumed it would not be. The expansion of the actual nodes now begins with function 225 (FIG. 11D).

Beginning with function 225 (FIG. 11D) we are going to expand the node which was just closed. The nodes which are found in expanding the dummy start node will be those related to the real problem.

Function 225 sets a register KCON to the value found in the NODE table at location (CLOSED, 2). This is merely a number identifying the conflict to which the node belongs. Function 226 sets a register LCON with the value of the next conflict. Since the NODE table had been cleared at function 206, the value of KCON is zero, and the value of LCON is 1, the first conflict in the conflict table. Function 227 determines if LCON is greater than the number of conflicts in this group. Since this is the first conflict it would not be and functions 228 and 229 set a register J equal to 1. This register will be checked to determine how many times the loop from functions 229 through FVALUE is performed (generally it should be performed twice). Function 230 therefore checks the value of the register J against the quantity 2, and since it is less than 2, we perform functions 231 to increment the register NNODE (originally set at function 203). Function 232 compares NNODE with the quantity contained in the register LIMIT. This comparison is to limit the number of nodes which are expanded in an effort to insure the processing time does not grow out of bounds. We have found that a relatively large value is suitable for LIMIT. The actual numerical quantity depends on many factors such as the processing and memory capacity available as well as the relative importance of optimization. Assuming that we have not more nodes than LIMIT, function 233 makes certain entries in the NODE table. At the location (NNODE, 1), which is the first column of the second row, the value stored in CLOSED is inserted; this identifies the predecessor of the current node. At the location (NNODE 2), which is the second column of the second row, the value stored in LCON is inserted. That is the conflict to which the current node belongs, i.e., conflict 1. Function 234 tests the value of J against the quantity 2, and since it is not equal to 2, the FVALUE routine is performed to determine the FVALUE for one of the two nodes associated with this conflict. As we will see in a later portion of this description, that routine also makes an entry of the heuristic value into the NODE table. Function 229 then increments the quantity J, from 1 to 2, but we still proceed to function 231, where the quantity NNODE is incremented. Function 232 compares NNODE to LIMIT, and function 233 makes the appropriate entries in the NODE table corresponding to this, the third node. Function 234 determines that J is equal to 2, and function 237 enters 1 to the node table at location (NNODE, 4). This is an indicator to the routine FVALUE that, in determining the heuristic value of this node, the order of the movements in the conflict should be reversed. Thus prepared, the routine FVALUE is again performed, and at function 229 J is again incremented. At this point, function 230 determines that J is greater than 2 and we proceed to function 208 (FIG. 11A). Function 208 tests the quantity of OPE against 0. While the reader might believe this quantity is zero, since it was initialized at 1 (function 203) and decremented to zero at function 223, that is not normally the case, since in the routine FVALUE this quantity is normally incremented again.

The FVALUE routine also makes an entry to the OPEN list for each of the two nodes whose FVALUE has been determined, so that at function 209 the quantity K is set to the first entry on the OPEN list, quantity MINNODE set equal to 1 so the entire OPEN list may be searched for the node with smallest heuristic value. OPEN(1) is the first one to look at. (OPEN(1) is OPEN(MINNODE)), the quantity MIN is set to the entry of the node table at location (K, 3). This is the heuristic value of the node. Functions 212 and 213 set at indicator J equal to 1 and function 214 compares J with the quantity OPE. Assuming that J is less than or equal to OPE, the register K is reset to the value at location J on the OPEN list and the register TEMP is set to the value in the node table at (K, 3). Function 217 checks whether this is a goal node. Assuming it is not, function 218 compares TEMP and MIN. Assuming they are different, function 219 compares the quantity TEMP with the quantity MIN. This is comparing the heuristic value of two different nodes. Assuming that TEMP is not greater than or equal to MIN, we then put the heuristic value in TEMP into MIN and put the quantity J into MINNODE. As a result, MONNODE points to the node with the lowest heuristic value and that value is stored in MIN. On the other hand, if TEMP is greater than MIN, then we have already identified the node of minimum heuristic value and we skip to function 213 to increment the J register. Since we normally would have put two nodes in the OPEN list, J would still not be greater than OPE, and we would repeat the sequence of functions 215 through 220 to determine which of the two nodes had the lowest heuristic value and put its index (in the OPEN list) into register MINNODE, and put its heuristic value into MIN. We would then skip to functions 221 through 224 where the node with the lowest heuristic value is removed from the OPEN list and is again checked for a goal node. Assuming it was not a goal node, we would then look back through functions 225 through 234, obtain two new nodes, determine the heuristic value of these in the routine FVALUE, and again come back at function 208.

Assuming that successful resolution of the problem is possible at some point function 224 would determine that the node we closed was a goal node and we would skip to function 240 (FIG. 11F).

Finding a goal node (as at function 224) implies a successful conclusion to the search. The purpose of functions 240 through 252 is to determine which goal node was located and the sequencing implied. Function 240 and 241 set a counter J equal to 1 and 242 determines if J is greater than NGOAL, the number of goals on the GOAL list. This number is set to zero at function 203 but when a goal node is found in FVALUE the number contained in NGOAL is incremented. Therefore, assuming that we have found a goal node, the quantity in NGOAL would be equal to at least 1. However, function 242 will determine that J is not greater than this quantity and function 243 would determine if GOAL (J) equals CLOSED, the CLOSED node. If not, we look back to function 241 to increment J until we determine that the goal node we have found is closed. The functions 244 and 245 set up another counter K to a value of 1 and function 246 determines if K is greater than PSTCNT; greater than the number of psuedo-trains we are working with. Assuming it is not, an entry is made from the table MASTDEL at location (J, K) into the psuedo-train table PSTTAB at location (K, 6). We will see that in operation of FVALUE, entries are made to this master delay table, MASTDEL, and thus the entry into the psuedo-train table is copied therefrom. By looping through function 245, 246 and 253, the appropriate entries are made in the psuedo-train table. When we have looped through this a sufficient number of times, so that K is greater than PSTCNT, functions 247 and 248 reset the J counter to 1, to determine the sequencing implied by this goal node. Function 249 determines that we have completed this by comparing J to STOP. Assuming we have not, function 250 enters into a register IPST, the information found in the conflict table at location (J, 1); this is the identity of the first psuedo-train in conflict J. Similarly, the same function inserts into JPST the identity of the second psuedo-train in the same conflict.

Functions 25–252 and 254–255 determine the sequencing implied by the resolution. Function 250 makes entries to IPST and JPST from the CONTAB, assuming IPST is the first movement. Function 251 determines the earliest time that train J will be allowed to proceed if train I is allowed to go first. This is the sum of the interpolated scheduled arrival time of I plus the delay already experienced by train I plus the LAPSE entry (I, J). Function 252 determines the time that train J will be ready to proceed. Function 254 compares these and reverses the sequencing if JTME > ITME.

Function 256 determines if the entry at the conflict table for train J, column 3 has a 1. This would have a 1 only if this particular change was possible only with approval, and then this would only occur on the second run through the routine. Assuming it is not, we turn to function 248 (FIG. 11F) and increment the J counter to pick another conflict to determine the sequencing thereof. This loop continues, i.e., functions 248 through 252 and over to 254 until we have handled all the conflicts, at which time we skip to function 258 (FIG. 11H).

Function 258 checks the flag SWITCH. If it is equal to 0 then we have successfully concluded the search without requiring re-sequencing and we exit through function 265. The conflict table has now been arranged so the recommended sequencing is contained therein. Function 261 determines if the counter I is equal to the quantity contained in GRPS, the number of different conflict groups originally determined. If it is not, function 264 increments the quantity I and we go back to the next conflict group to determine the identity of psuedo-trains and perform the time calculations before again re-entering the search subroutine. On the other hand, if we do have an identity at function 261, then function 262 sets the number of conflicts equal to 0, all having been handled, and function 263 clears column 5 of the manual table to zero, operator intervention is not required and the system returns to the reservation routine.

If, on the other hand, the flag SWITCH did not equal zero, then, as indicated in function 259, this has been the second try, in which we achieved success. This implies, as indicated in function 260, operator approval, since resequencing is required. We go again into function 261.

Figure 11I:
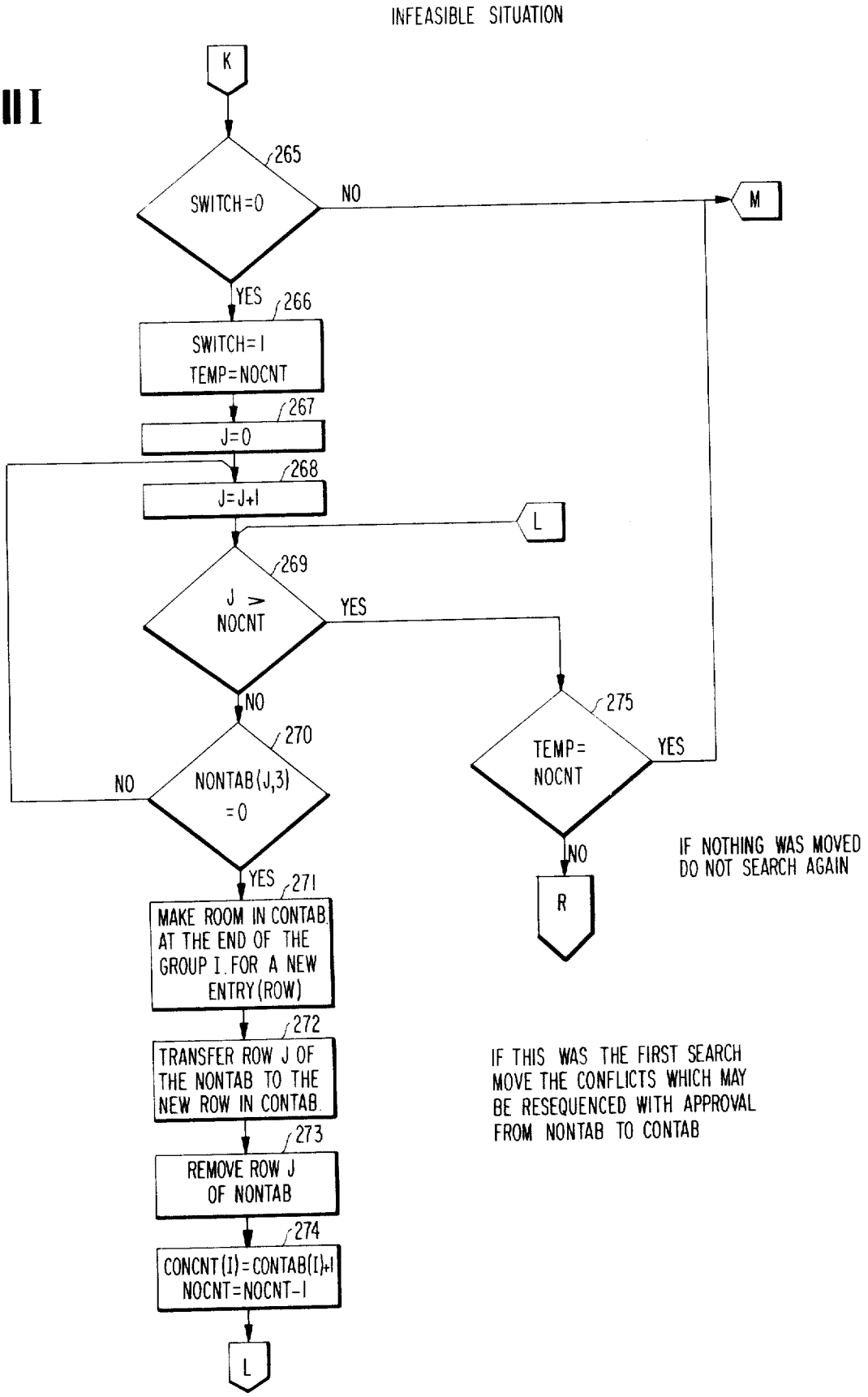

Returning for a moment to FIG. 11D, we will again discuss function 232, and assume that the number of nodes has exceeded the limit without obtaining a successful conclusion. Function 235 therefore sets the flag SWITCH equal to 1, function 236 calls the operator and we proceed to function 265 (FIG. 11I). Before proceeding to discuss the functions 265 through 275, it is appropriate to indicate that these functions can also be performed if function 208 (FIG. 11A) determines that the counter OPE has been decremented to zero without a successful conclusion.

In either case, we determine if flag SWITCH is equal to 0. If it is not, it means that we have exhausted available searching and function 260 is performed to present the problem to the operator. On the other hand, if SWITCH did equal zero then we can perform another attempt and function 266 sets the flag SWITCH equal to 1, and the quantity stored in NOCNT is loaded into a register TEMP. Functions 267 and 268 set up a counter equal to 1, and then function 269 compares that with the quantity in NOCNT. The quantity stored in NOCNT is the number of entries in the table designated NONTAB, which initially includes those conflicts which cannot be re-sequenced without approval. The loop here involved will move certain entries from this table into the conflict table. In effect, the first pass through we have attempted to find a resolution that allowed only re-sequencing of those trains that can be re-sequenced without approval. Reaching this location implies that a successful resolution has not been found and that to attempt to find a successful resolution it is necessary to re-sequence at least some trains. Therefore, some entries will be moved from NONTAB back into CONTAB, by means of the functions shown in FIG. 11I. Function 269, in comparing J and NOCNT, determines if we have completed the loop. If J is greater than NOCNT, then function 275 compares TEMP with NOCNT. Since these were made equal at function 266, they would only still be equal at this point if no decrementing had occurred (see function 274) as a consequence of moving entries from NONTAB into CONTAB. If no movement has taken place, then there were no entries in NONTAB which could be re-sequenced, and therefore a failure to find, automatically, a conflict resolution is confirmed and we again skip to function 260. If, however, at function 275 there is no equality, then we go into FVALUE (FIG. 12A).

On the other hand, assuming, at function 269, though we have not iterated sufficiently to increase the J above NOCNT, then we perform function 270 in which we look at the NONTAB table at location (J, 3) and check to see if it is equal to zero. If it is not, that means that this conflict is not re-sequenceable and we have to go back to function 268 and pick a different conflict to see if that is re-sequenceable. If, however, the entry at this location is equal to zero, then it means the conflict is re-sequenceable and functions 271 through 274 are performed. In effect, this conflict is moved from NONTAB into CONTAB. Appropriate entries are made into registers by function 274 to reflect this change and then we return to function 269 to continue moving entries from NONTAB into CONTAB.

That completes the discussion of the routines shown in FIGS. 11A through 11I. Under normal circumstances, in completing these routines the system will refer to FVALUE (See FIG. 11D for example) or through function 275. We now refer to FIGS. 12A through 12L.

Figure 12A:
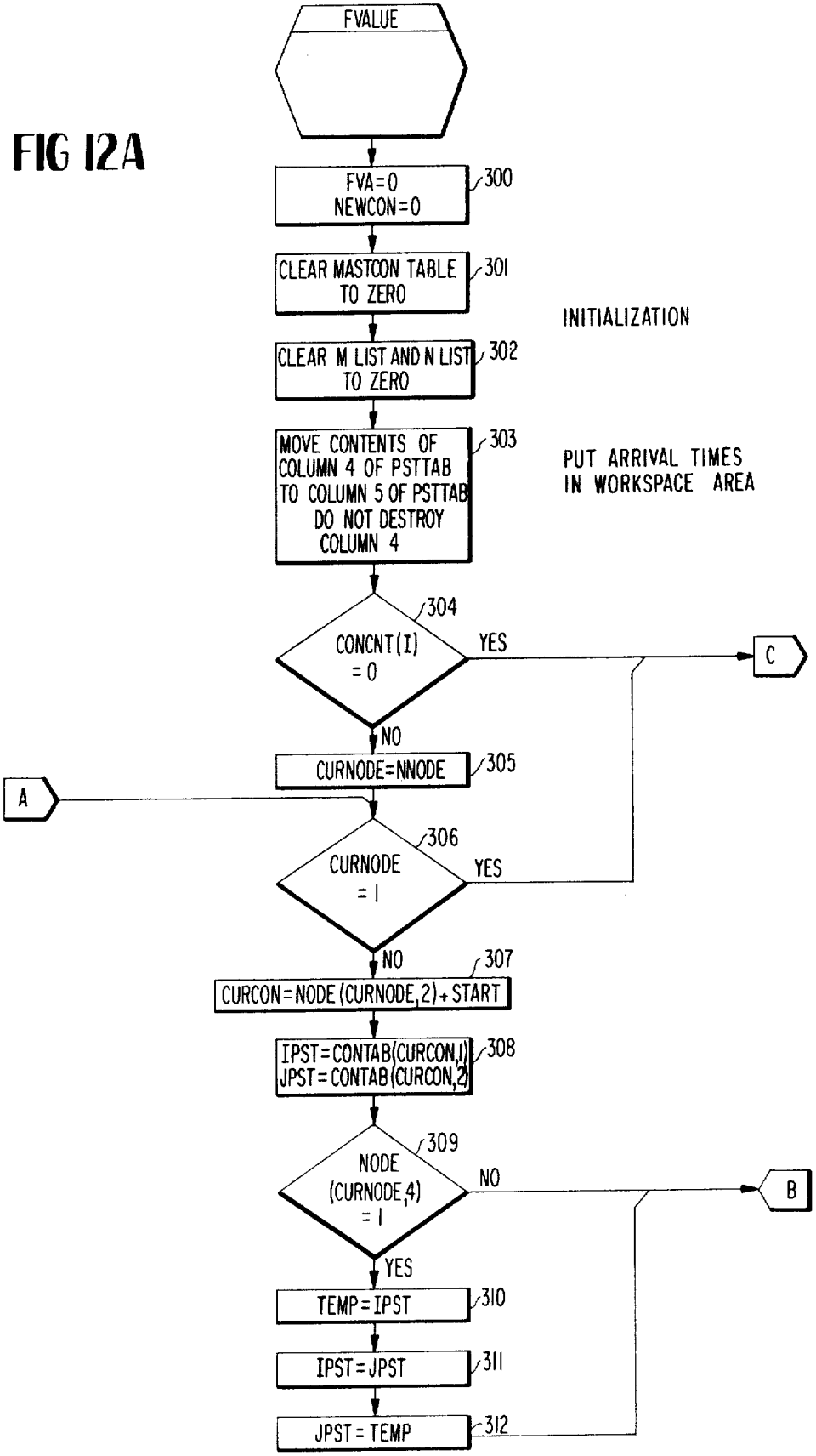
Figure 12C:
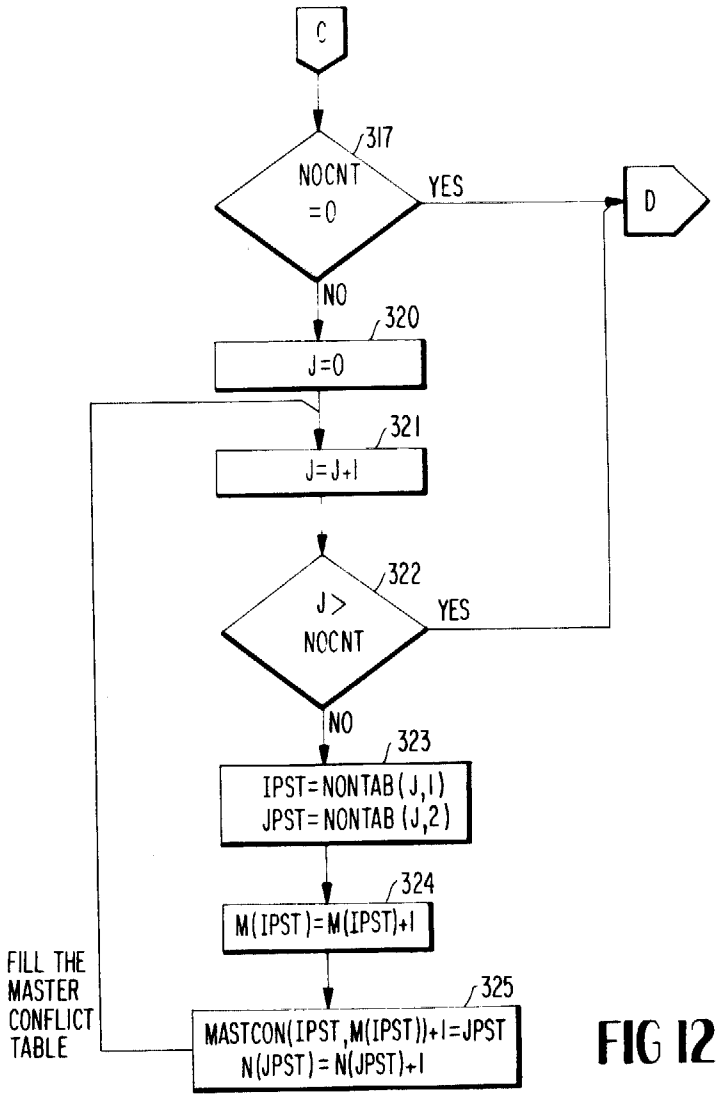
Figure 12B:
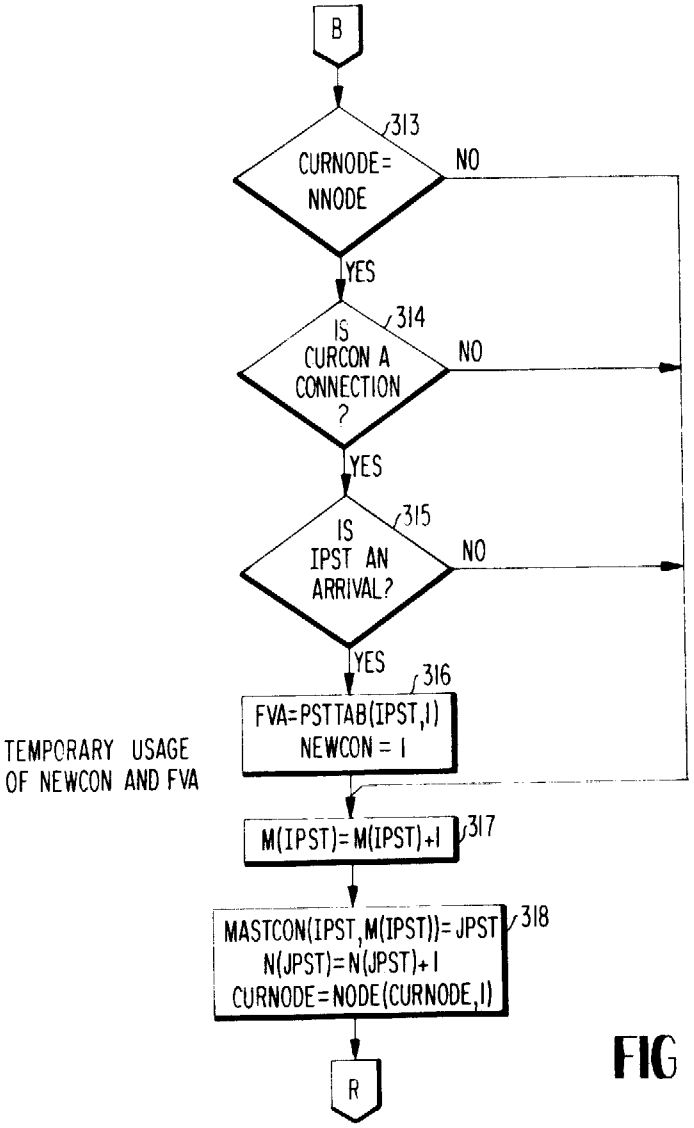

The portions of the FVALUE subroutine shown in FIGS. 12A, 12B and 12C perform the following functions:

(1) begin at the node whose FVALUE is to be determined and work back to the start node, at the same time building a master conflict table having a row for each psuedo-train and several columns to contain the psuedo-train numbers of the psuedo-trains which are second in the conflict pairs in which the current psuedo-train is the first, an M list having one entry per psuedo-train of the number of conflict pairs in which each psuedo-train occurs as the first, and an N list having one entry per psuedo-train, of the number of conflict pairs in which each psuedo-train occurs as the second;

(2) when the start node is reached, completing the master conflict table, M and N lists with the entries found in NONTAB, i.e., those conflicts which are not re-sequenceable.

These functions are performed as follows. Functions 301 through 303 initialize the system; registers FVA, NEWCON, as well as the M and N lists are cleared to zero (functions 300 and 302) as well as the master-conflict (MASTCON) table, function 301. Function 303 moves the contents of column 4 of the psuedo-train table to column 5; this is the arrival time for the several psuedo-trains, at the conflict zones.

Function 304 determines if the number of conflicts is equal to zero, i.e., are there no re-sequenceable conflicts? Assuming there are some, function 305 sets CURNODE equal to the quantity in NNODE. Function 306 determines if the quantity in CURNODE equals 1, indicating the start node. At this point in the processing, it would not, and function 307 would be performed to set CURCON (identification of the current conflict) equal to the quantity found in the node table at the location (CURNODE, 2) plus an index START. Function 308 makes entries into the IPST and JPST registers, specifically the identities of the pseudo-trains found in the first and second columns of the table CONTAB at row CURCON. Function 309 determines if the quantity in the node table at location (CURNODE, 4) is equal to 1. Referring back to FIG. 11D, function 237 sets this quantity equal to 1 if we are going to attempt to find the FVALUE for the node with the reversed sequence of trains. Therefore, if this quantity is 1, functions 310 to 312 reverse trains I and J and then proceed to function 313. On the other hand, if this quantity is not 1, we proceed directly to function 313 from function 309.

Function 313 determines if CURNODE is the same as NNODE. At this point, since we are just beginning the search, it is, and function 314 determines if the conflict CURCON is a connection. This information is found in column 4 of the conflict table for this conflict. If it is, function 315 determines if train IPST is an arrival. It it is, function 316 stores the train identifier for this train in FVA and increments NEWCON. Function 317 is then performed to increment the value on the M list corresponding to IPST. If, at function 313, we determine that the current node is not equal to NNODE, if the current conflict is not a connection or if IPST is not an arrival, then function 316 is not performed. After completing function 317 function 318 makes an entry to the master conflict table at the location corresponding to (IPST, M(IPST)) with the identity of the train JPST. At the same time, the N list for train JPST is incremented and the register CURNODE is changed to the preceding node, found in the NODE table in column 1.

We then return to function 306 and again determine whether the new quantity CURNODE is the start node. If it is not, the loop consisting of functions 306 through 318 is again performed and will be performed as many times as necessary until we have linked back to the start node. When we have arrived at the start node, we have, in MASTCON, the information required for those nodes between the node at which we started and the start node, and we also have written into the M and N lists the number of conflicts in which each of those psuedo-trains is either the first or the second. At that point, we perform function 319, and look at the quantity NOCNT. In effect, we are going to fill into the master conflict table the conflicts that are in NONTAB, if any, along with appropriate entries to the M and N lists. This is performed by functions 320 and 325. When we have made those entries, or if there are not entries to make, the routine shifts to function 326. (FIG. 12D).

Figure 12D:
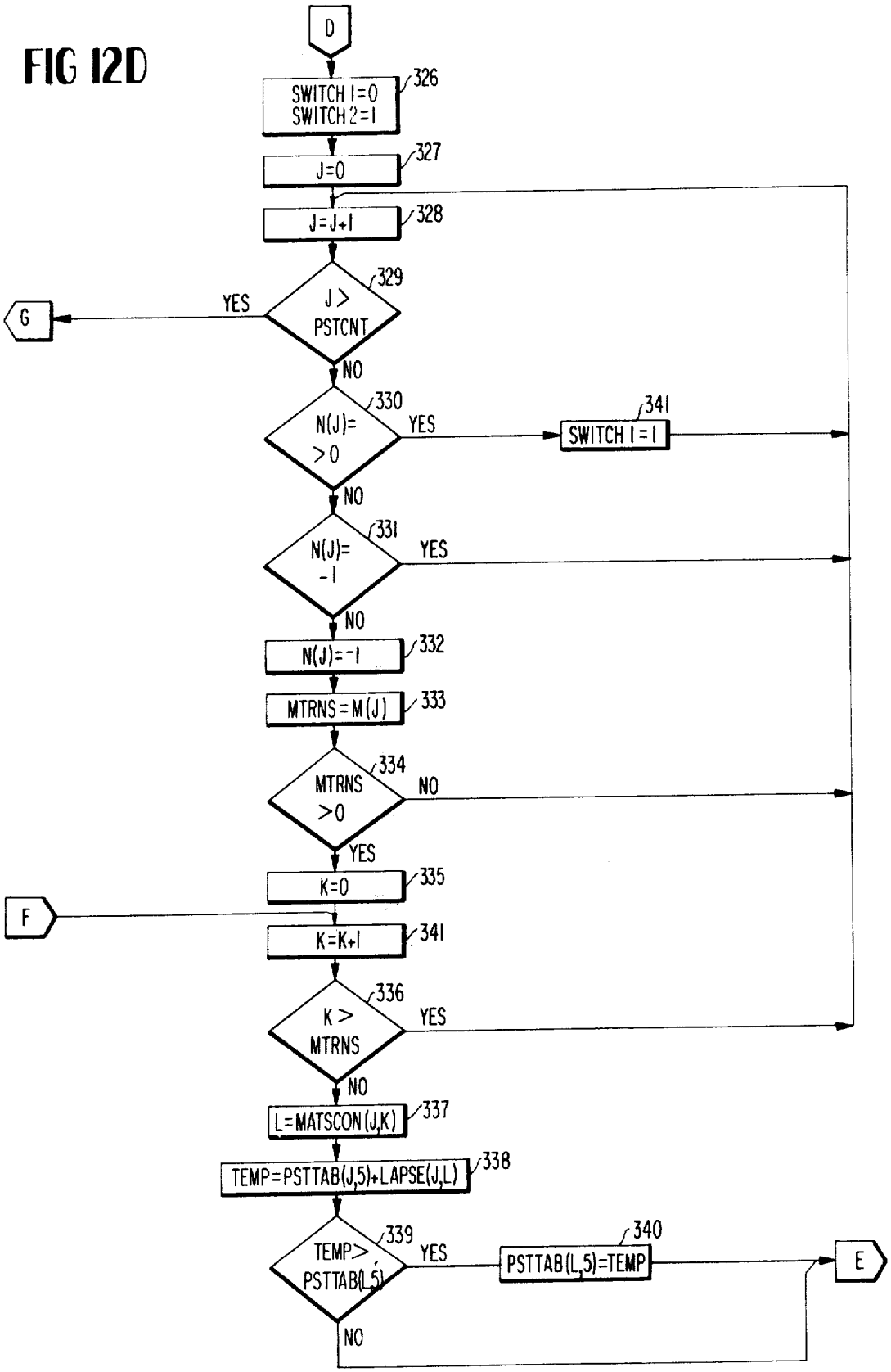
Figure 12E:
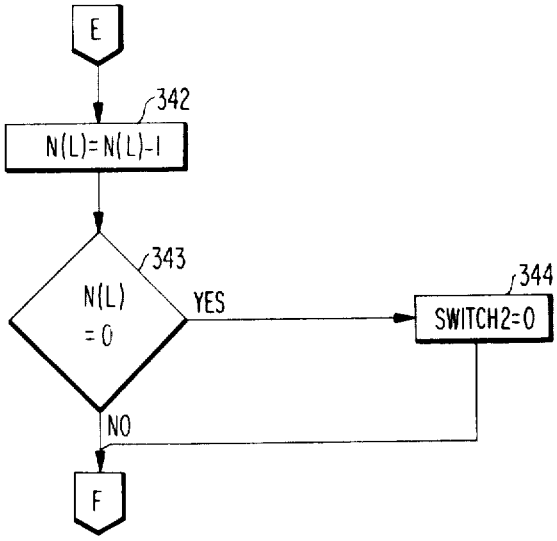
Figure 12F:
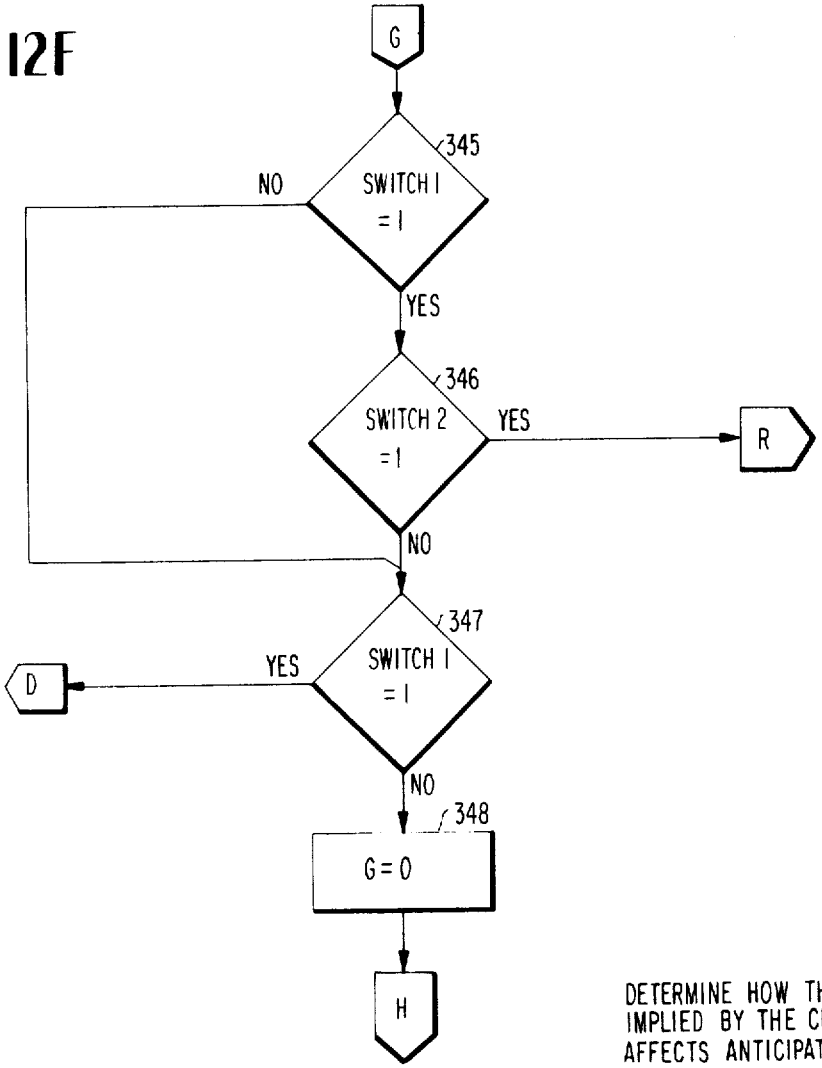

The portions of the subroutine illustrated in FIGS. 12D, 12E and 12F determine how the sequencing implied by the current node affects anticipated arrival time. Two flags, SWITCH1 and SWITCH2, are set to zero and one respectively, as an initialization. Function 327 and 328 set up a pointer J and function 329 determines if J is greater than PSTCNT, the number of psuedo-trains we are working with. In the initial passes through this subroutine it would not, and function 330 determines if there is an entry on the M list for this psuedo-train. The N list is, of course, the number of times that a psuedo-train appears as a second trains in a conflict. Since this routine is designed to work with J pointing at the first psuedo-train, if there is an entry on the N list for the J psuedo-train, the function 341 sets a flag, SWITCH1, to the value 1 and looks for a different psuedo-train. Assuming, however, that the entry is not greater than zero then function 331 determines if that entry equals minus 1, i.e., we settled all conflicts in which this is a movement. If we loop back to function 328 and select a different psuedo-train. If we have not, however, function 332 is performed to set that entry at minus 1 indicating that this psuedo-train is settled. When the N list entry is 0 we may have to review this psuedo-train as a first movement. Function 333 extracts the number of conflicts in which this train, J, occurs as the first movement. Function 334 determines if that is greater than zero. If not, we again loop back to function 328 to select a different psuedo-train. Functions 335 and 341 initialize another counter K. The goal here is to examine each conflict, and to do so by starting with a psuedo-train listed as the first train in the first conflict and examining each conflict in which that train is a first train. If we do that for every train which is the first train in a conflict, we will have examined all conflicts. The counter K, therefore, counts the number of times we have looped through looking for the conflict in which this psuedo-trains J is the first train. The total number of such conflicts is found in MTRNS (set by function 333). Therefore, when we have incremented K above this value we can loop back and perform the same function again. Assuming we arrive at function 336 for the first time, K would normally not be larger than MTRNS and therefore, we would enter into L, the quantity we loaded in the master conflict table at the location (J, K). This is merely the Kth second movement for this psuedo-train. We load, by function 338, into TEMP the sum of the arrival time of train J plus the necessary lapse time before train L can proceed. We then compare this quantity with the time at which psuedo-train L will arrive at the conflict zone in function 339. If TEMP is greater, then we, in effect, increment the quantity at location (L, 5) for psuedo-train L by the amount of LAPSE (J, L). On the other hand, if pseudo-train L arrives beyond the necessary time there is no need to incremenr it, and in either event, we then proceed through to functions 342–344.

Function 343 decrements the N list for train L and function 343 determines if we have concluded with pseudo-train L as a second movement. If we have, we flag that, at least one pseudo-train can be looked at as a first movement at function 344, and in either case, return to function 341 and increment our counter K to see if we have yet completed with pseudo-train J. The loop 341 through 344 is completed as many times as required until K exceeds the quantity MTRNS. At that point, the loop back to function 328 in increment J until such time as J is greater than the number of pseudo-trains, i.e., we have run through all the pseudo-trains, made the necessary changes in the pseudo-train table to account for any delays necessary to resolve the conflicts, and then proceed to function 345.

In the processing above, we may have passed, at function 330, a pseudo-train, and flagged it by setting SWITCH1 (function 341). Function 345 and 347 determine if we have done that, and if we have we go back to function 326 and pick up that pseudo-train. By completing the N list, taking care of all the second movements, we should have changed the flag SWITCH2 (function 344). If we have not, this is detected by function 346 and we exit through a failure mode to be discussed with reference to FIG. 12M.

Figure 12G:
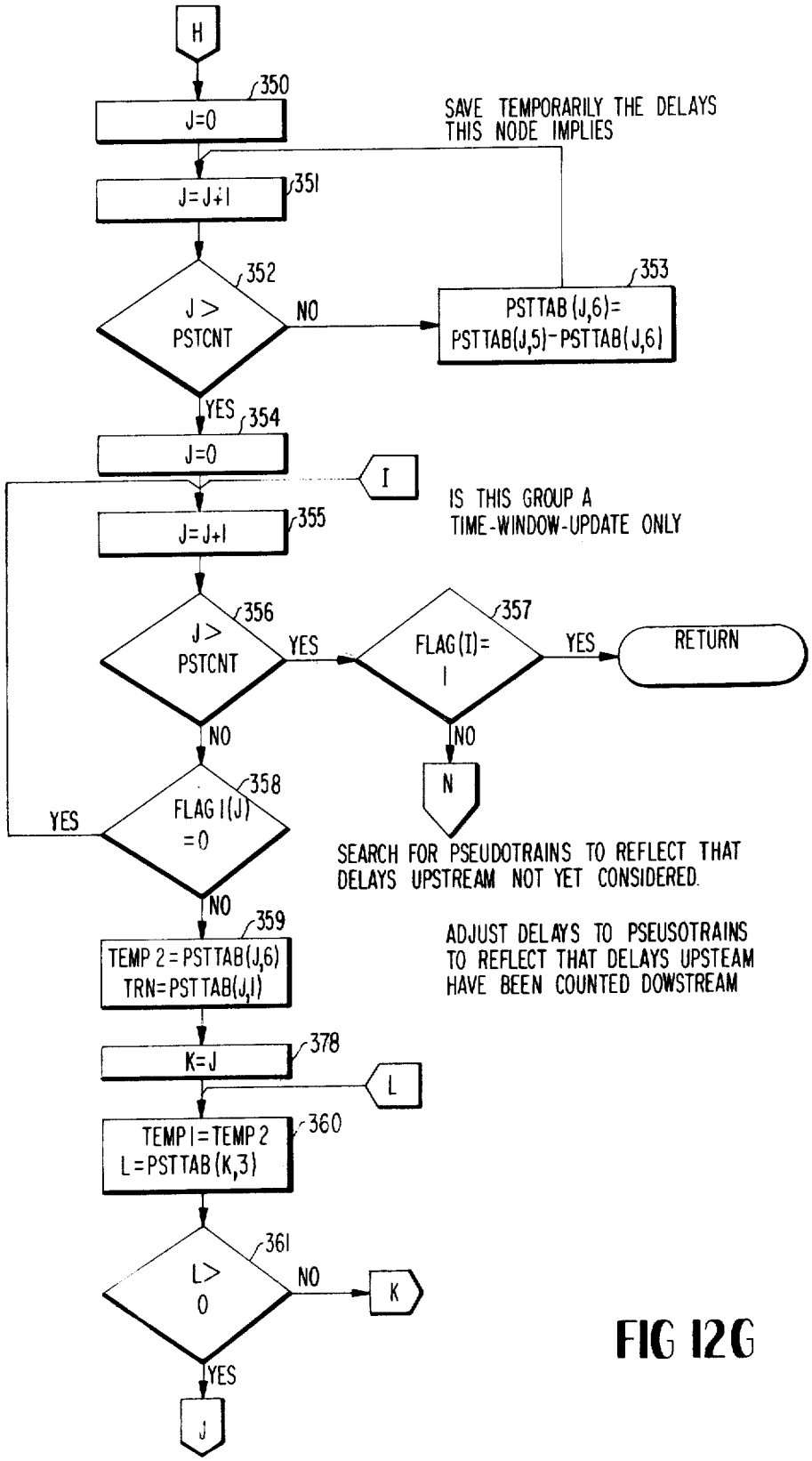
Figure 12H:
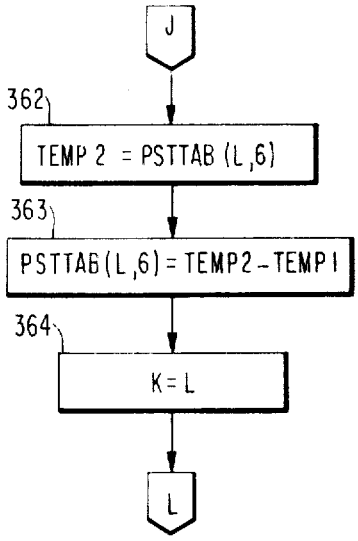
Figure 12J:
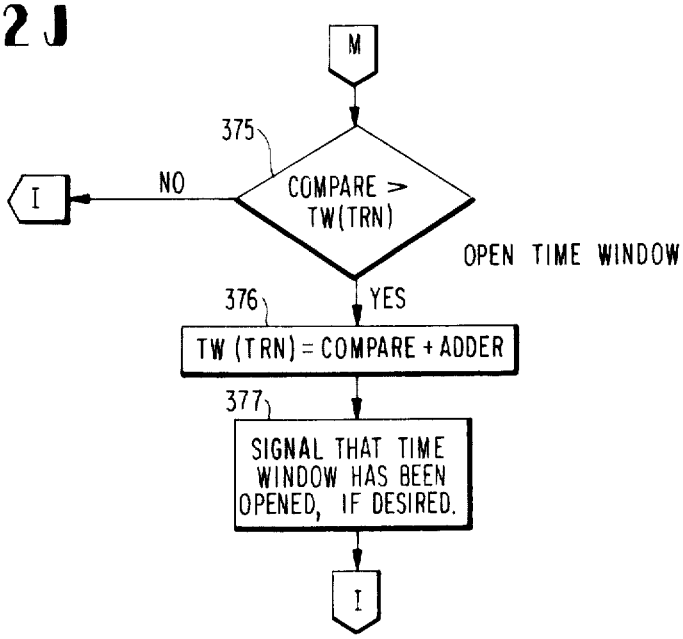
Figure 12I:
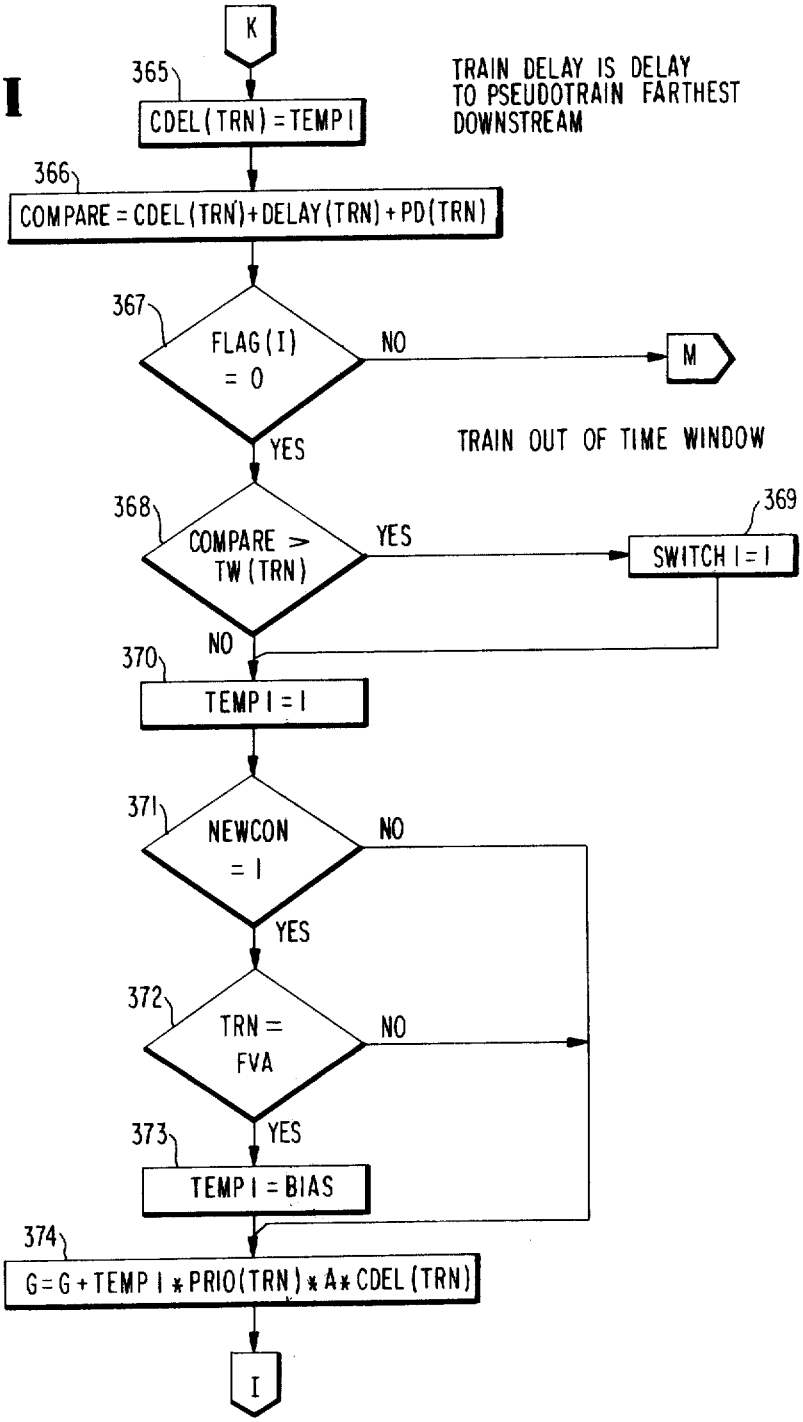
Figure 12K:
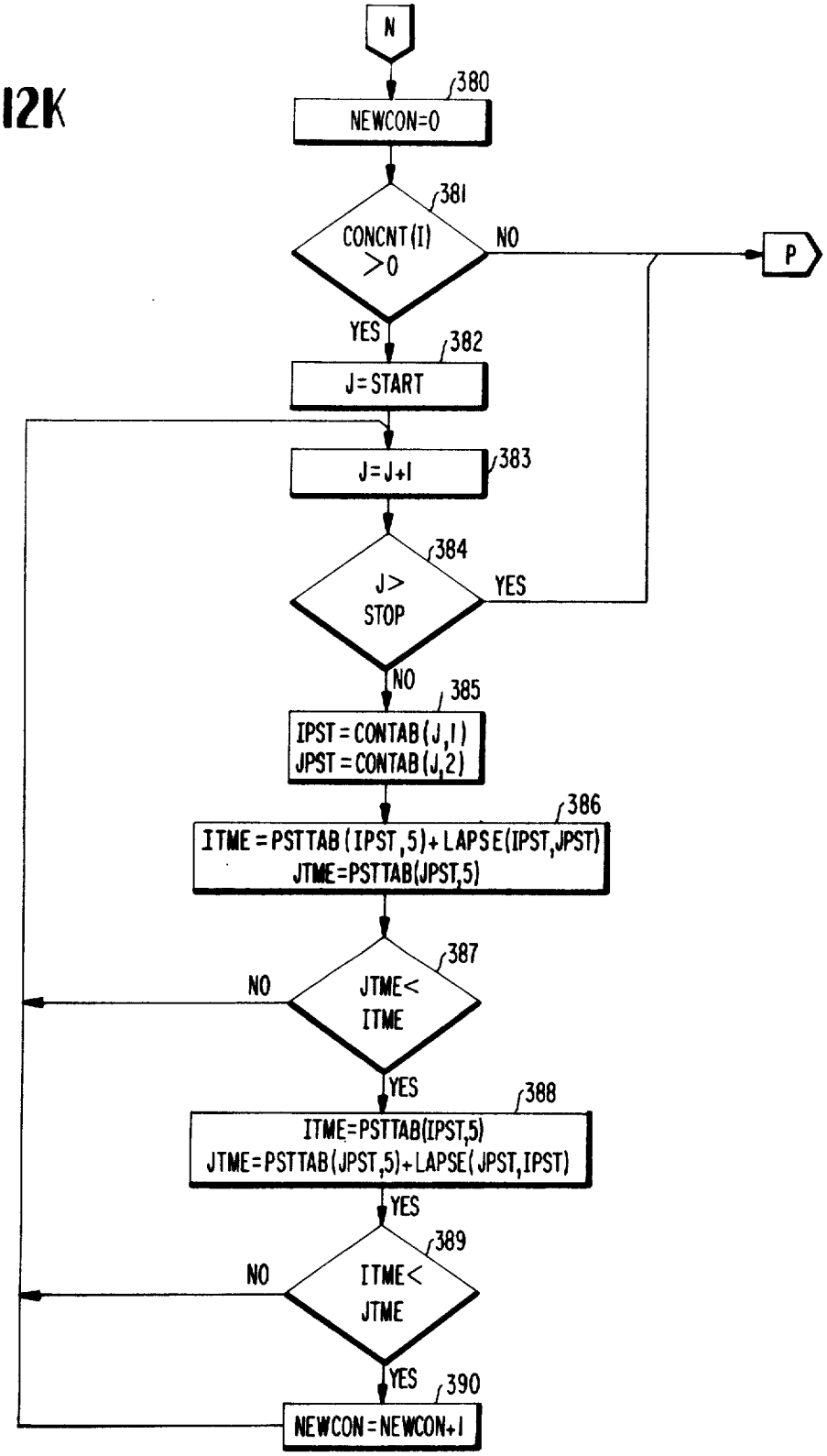

After completing all the necessary arrival time changes in the pseudo-train table, we initialize SWITCH1 to zero and initialize G to zero and then proceed to function 350 (FIG. 12G).

Functions 350 through 353 are designed to write any delays imposed on the train by reason of the conflict resolution into a work space in the pseudo-train table, column 6. Thus, as each pseudo-train is detected in turn, by function 351, and assuming we have not exceeded the number of pseudo-trains (determined at function 352) the delay imposed on the train by the sequencing, i.e., the difference between its arrival time and its allowed proceed time (the difference between the quantities in columns 5 and 4 in the pseudo-train table) is written into column 6 by function 353. After this has been done for each pseudo-train we proceed to functions 354 and 355, which initialize a J counter to a count of 1. The loop comprising functions 355 through 358 in effect searches for the farthest upstream pseudo-train no yet considered. A previous routine (not disclosed in detail herein) had marked the farthest upstream pseudo-train of each actual train by putting a 1 bit in a list, FLAG1 for that pseudo-train. Thus, function 358 continually sees zeros until it discovers the farthest upstream pseudo-train. At that point a register TEMP2 is loaded with the allowable proceed time for the pseudo-train and another register TRN is loaded with the identity of the train corresponding to this pseudo-train. Function 378 then loads register K with the quantity J and function 360 loads register TEMP1 with the quantity found in TEMP2 and puts the link to the next downstream station for this pseudo-train into L (this information is found in the pseudo-train table at location (K, 3)). Function 361 then checks to see if L is greater than zero. If it is, then there is a downstream link and we skip to function 362 which puts into a register TEMP2 the allowable proceed time for this pseudo-train, which is now the next downstream pseudo-train. Function 363 adjusts the pseudo-train table to reflect only the added delay for that pseudo-train by subtracting the delay imposed upstream, which had been contained in TEMP1. Function 364 then sets register K equal to L and the system loops back to function 360. This looping process (functions 360–364) is continued until the furthest downstream link is exceeded and we then skip to function 365.

This function loads a list entitled CDEL for the specific train with the delay found in TEMP1. Function 366 then loads COMPARE with the sum of the CDEL entry for the train plus the entry in DELAY for the train, as well as the entry for PD, for that train (the quantities DELAY and PD are derived from the train data with which the system begins the resolution). There should be space in the table of train records kept by the reservation program. Function 367 determines if this group has been entered manually by examining the FLAG for that group. If it had not, function 368 determines if the quantity COMPARE is greater than the quantity TW(TRN). As discussed above, each train has associated therewith a time window which is not to be exceeded. The determination is made in function 368, and if it had been exceeded this is flagged by setting SWITCH1 to a quantity 1 (function 369). Whether or not the time window had been exceeded, function 370 sets TEMP1 to 1 and function 371 checks NEWCON to see if it is equal to 1. We proceed to function 372 and determine if the train we are working with is part of a connection dependency, indicated by NEWCON 1. If it is, we insert into TEMP1 the quantity BIAS, at function 373. We then compute the quantity G as the sum of G (which had been set to 0 at function 348), and BIAS.PRIO (TRN).A.CDEL(TRN) in function 374. This is a part of the computation of the FVALUE for this train. We then return to function 355 and select a different pseudo-train and again proceed to the following functions. After having treated all pseudo-trains we check FLAG for this group to see if it was manually entered in function 357. Assuming it was not, we proceed to function 380.

In functions 380 through 391 we compute the actual value of FVA. To perform this, we initially set NEWCON to zero (function 380) and see if we have any conflicts left to work with (at function 381). Assuming we do, we set up a counter at function 382 and 383 to take us between start and stop values, and function 385 starts with the first two pseudo-trains of the first conflict in this group and notes their identities in the IPST and JPST registers. Function 386 computes ITME and JTME by adding the arrival time for the IPST pseudo-train to the lapse time since we assume that pseudo-train IPST proceeds first, JTME is merely the arrival time of JPST. Function 387 determines if JTME is less than ITME, and assuming it is, we have a potential conflict. Function 388 operates on the reverse principle, and if, as they are computed, ITME is less that JTME, then we have a further actual conflict and we thus increment NEWCON at function 390. We then loop back and continue, continually to increment NEWCON until we have reached the conclusion of our search at which point we compute FVA in function 391. Function 392 determines if there are any NEWCON. If there are, then we must proceed with the search, and we skip down to function 400 where we determine if the flag SWITCH1 had been set to one, indicating an infeasible solution. If that was not the case, then we increment OPE, put NNODE on the OPEN list, (function 402) and insert the now computed FVA value into the node table at the proper location, function 403, and return to the searching program.

On the other hand, if there are no new conflicts, then we have reached a goal node and indicate that fact by marking, in the NODE table, column 5 of the corresponding node at function 393. We increment the GOAL counter indicating we found another goal node, function 394, and identify it at function 395. Function 398 determines if we have worked to the end of the pseudo-train table and if we have not, we make a proper entry into the master delay table for this node at function 399. After completing these operations we then also proceed to function 400, as before, to initialize the system for a further search.

If, at any time during the process, we reach function 400 with SWITCH set (by function 369) to indicate violation of a time window, then function 404 loads a large number into FVA and function 405 marks the entry in the node table for this node; the zero indicates it is not a goal node, and function 403 is performed to load the quantity BIG into the node table for the FVALUE.

If, as will be explained later, this portion of the routine is entered merely to enlarge a time window, in response to an operator's instruction, when reaching function 367 (FIG. 12I) the FLAG will not be zero. As a result, function 375 will be performed where we check to see if COMPARE is greater than the time window. If it is, function 367 opens the time window, increases the value stored therein, function 377 indicates that this has been accomplished and the system returns to function 355 where it is available to operate on other pseudo-trains.

After completion of function 110, function 111 (FIG. 5A) determines if a feasible solution was found. If it was function 115 (FIG. 5C) determines if success was achieved on the first pass (i.e., without re-sequencing) or on the second pass (re-sequencing required). If on the first pass, the order reflected in CONTAB is fixed and, after outputting the results (function 117), we loop back to function 102 (FIG. 5A) to search another group. If success was achieved on the second pass, function 116 writes this group onto the MANUAL table. This allows for operator approval of the re-sequencing suggested. In the interim, the routine loops back to function 102 (FIG. 5A) to search other groups.

If, at function 111, no feasible solution was found, the routine skips to function 112 (FIG. 5B) to determine if this was the second search. If it was, then no solution was found even with re-sequencing and function 113 writes this group to the table MANUAL for display and then loops back to search other groups. The operator will be informed of the unsuccessful search and he may manually determine the sequencing or he may simply expand some time windows and allow the system to try again.

If no feasible solution was found on the first search, function 114 (FIG. 5B) permits re-sequencing and the routine loops back to function 110 (FIG. 5A) to try again with the identical conflict group.

The operator is called in two situations; either to approve a successful solution which requires re-sequencing or to respond to a group for which no successful solution has been found. In the latter case, and also if he does not approve of the recommended resequencing, he manually enters the desired sequencing. These are flagged as manually entered and are enforced as entered, i.e., the system does nothing with them. If, on the other hand, he approves the recommended resequencing, then that is the sequencing that will be followed.

In any event, the CONTAB will, at the conclusion of operations, contain the desired sequencing of moves. The apparatus disclosed in the U.S. Pat. No. 3,976,272, or equivalent apparatus, then enforces the desired sequencing by clearing routes for the desired moves in the indicated order.

What is claimed is:

1. Conflict-resolving train control apparatus for a railroad, which railroad includes a plurality of potentially conflicting routes and railroad traffic controlling equipment, said equipment operating in response to signals communicated thereto by a central station, said equipment further communicating information respecting the condition of said equipment and the location of railroad traffic thereon to said central station, said conflict-resolving apparatus comprising:

storage means for storing information as to the railroad configuration, status of traffic controlling equipment, location of traffic, nominal schedule of said traffic, and for further storing of information respecting potential conflicts which require resolution in light of actual railroad traffic on said railroad, processor means operating in response to said storage means for initiating a heuristic search for resolution of said conflicts, said processor assigning to each potential conflict resolution, a cost related to the delay required by said resolution, said processor searching for a successful resolution through a path of potential conflict resolution on the basis of said cost, and means responsive to discovery of a successful resolution for storing a desired order of conflicting railroad traffic to eliminate said conflicts, said equipment for controlling said railroad traffic being responsive to said order of trains to control said traffic to eliminate said conflicts.

2. The apparatus of claim 1 wherein said cost includes a parameter related to relative train priority.

3. The apparatus of claim 1 wherein said cost includes a parameter related to the conflicts remaining between the conflict being examined and a potential complete resolution of all conflicts.

4. The apparatus of claim 1 wherein said processor compares said delay with a permissive maximum delay associated with each train, and which ignores the resolution being examined if said delay exceeds said maximum permissive delay.

5. The apparatus of claim 1 in which said processor is initiated into operation as a function of time.

6. The apparatus of claim 1 which further includes manual override means responsive to manual operation thereof to determine desired sequencing.

7. The apparatus of claim 1 wherein said cost is determined as being equal to $A \cdot g(n) + B \cdot h(n)$ wherein $g(n)$ is the sum of products of train priorities and train delays required for the resolution, $h(n)$ is the number of conflicts yet to be resolved, $A$ and $B$ being empirically determined constants.

8. The apparatus of claim 1 wherein said processor sorts various conflicts into conflict groups, each group being exclusive of trains of other conflict groups.

9. The apparatus of claim 8 in which said processor assigns a pseudo-train number to the appearance of each train conflict zone pair.

10. The apparatus of claim 9 in which said processor sorts each group of conflicts by pseudo-train.

11. The apparatus of claim 10 in which said processor determines a pair of LAPSE times for each pseudo-train pair having a common conflict zone, and wherein said LAPSE times are employed in determining said cost.

* * * * *